US009574312B2

(12) United States Patent
Eaves et al.

(10) Patent No.: US 9,574,312 B2
(45) **Date of Patent: *Feb. 21, 2017**

(54) SLEEVES FOR SIGN POSTS

(71) Applicant: EML Products Inc., Seattle, WA (US)

(72) Inventors: Christopher Scott Eaves, Seattle, WA (US); Willis Michael Morris-Lent, Seattle, WA (US)

(73) Assignee: EML PRODUCTS INC., Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/763,786

(22) PCT Filed: Feb. 17, 2014

(86) PCT No.: PCT/US2014/016726

§ 371 (c)(1),
(2) Date: Jul. 27, 2015

(87) PCT Pub. No.: WO2014/130399

PCT Pub. Date: Aug. 28, 2014

(65) Prior Publication Data

US 2015/0361684 A1 Dec. 17, 2015

Related U.S. Application Data

(63) Continuation-in-part of application No. 14/063,882, filed on Oct. 25, 2013, now Pat. No. 8,915,045.

(Continued)

(51) Int. Cl.
*E04C 3/00* (2006.01)

(52) U.S. Cl.
CPC ..... *E01F 9/623* (2016.02); *E01F 9/619* (2016.02)

(58) Field of Classification Search
CPC ..... E01F 9/623

(Continued)

(56) References Cited

U.S. PATENT DOCUMENTS 1,123,105 A * 12/1914 Crews ..... E04H 12/2215 52/165
4,084,914 A * 4/1978 Humphrey ..... E01F 9/0175 256/1

(Continued)

FOREIGN PATENT DOCUMENTS

DE 9214615 U1 3/1994
EP 0049726 A1 4/1982

(Continued)

OTHER PUBLICATIONS

International Search Report and Written Opinion mailed May 22, 2014, issued in corresponding International Application No. PCT/US2014/016726 10 pages.

(Continued)

*Primary Examiner* — Basil Katcheves
(74) *Attorney, Agent, or Firm* — Schwabe, Williamson & Wyatt, P.C.

(57) ABSTRACT

A sleeve for a post that is generally rectangular in horizontal cross-section, may have two or three panels, may have perforation which allow portions of one or more panels to be removed, may incorporate retroreflective materials, may have holes, bushings, and/or adhesive layers to facilitate attaching the sleeve to a post, may have top-bottom and side-to-side connectors to facilitate connecting the top of one sleeve to the bottom of another or the edge of one sleeve to an edge of another, may be accompanied by spacers to allow the sleeve to be connected to posts of different size and geometry.

16 Claims, 29 Drawing Sheets

Related U.S. Application Data

(60) Provisional application No. 61/850,769, filed on Feb. 21, 2013.

(58) Field of Classification Search
USPC ..... 52/835, 100, 147, 170, 834, 837; 232/39
See application file for complete search history.

(56) References Cited

U.S. PATENT DOCUMENTS 4,423,797 A * 1/1984 Batten ..... E06C 7/44 182/111
4,516,365 A * 5/1985 Chapman ..... E04H 12/2292 52/170
4,543,757 A * 10/1985 Cosgrove ..... E02D 27/42 248/158
4,574,507 A * 3/1986 Elliott ..... G09F 7/18 40/607.11
4,645,168 A * 2/1987 Beard ..... F16M 11/20 248/523
4,646,489 A * 3/1987 Feller ..... E04H 12/2253 256/DIG. 5
4,926,592 A * 5/1990 Nehls ..... 256/13.1
5,022,618 A * 6/1991 Barrett ..... A47G 29/1216 232/39
5,042,716 A * 8/1991 Robbins ..... A47G 29/1216 232/39
5,203,817 A * 4/1993 Klumpjan ..... E04H 12/2276 256/19
5,215,283 A * 6/1993 Gould ..... A47G 29/1216 232/39
D371,885 S * 7/1996 Pennington ..... D99/32
5,560,131 A * 10/1996 Gibson ..... G09F 7/20 40/607.12
5,622,356 A * 4/1997 Duggan ..... E04H 12/2292 256/1
5,636,482 A * 6/1997 Klager ..... E04H 12/2292 256/DIG. 5
5,970,677 A * 10/1999 Masters ..... E04B 1/2608 52/295
6,233,898 B1 * 5/2001 Burlando ..... G09F 13/14 116/63 P
6,390,436 B2 * 5/2002 Barnes ..... 248/548
6,516,573 B1 * 2/2003 Farrell ..... 116/63 R
6,641,910 B1 * 11/2003 Bries ..... C09J 7/02 248/205.3
6,840,507 B2 * 1/2005 Brown ..... E04H 17/1434 256/65.01
7,163,142 B2 * 1/2007 DeLine ..... A47G 29/1216 232/39
7,520,694 B2 * 4/2009 Dvoracek ..... E01F 9/015 404/10
7,523,715 B2 * 4/2009 Mettler ..... A47B 23/042 116/63 R
7,621,096 B2 * 11/2009 Ellis ..... E04B 2/7457 52/489.1
7,743,538 B2 * 6/2010 Parenti ..... E01F 9/623 40/607.01
7,980,034 B2 * 7/2011 Fehr ..... E04C 3/30 248/519
8,915,045 B2 * 12/2014 Eaves ..... E04H 12/00 52/100
2001/0045553 A1 * 11/2001 Pilcher ..... E04H 12/2292 256/64
2006/0174526 A1 * 8/2006 Kekeis ..... G09F 19/22 40/612
2009/0178318 A1 7/2009 Parenti et al.
2010/0176543 A1 * 7/2010 Burke ..... G09F 7/18 267/153

FOREIGN PATENT DOCUMENTS

EP 2138991 A1 12/2009
FR 1297202 A 6/1962
GB 2293616 A 4/1996
JP 200501612 A 1/2005
JP 2009264049 A 11/2009
KR 1999-0036711 U 9/1999

OTHER PUBLICATIONS

The Extended European Search Report mailed Sep. 27, 2016, issued in corresponding European Patent Application No. 14754519.8.

* cited by examiner

SLEEVES FOR SIGN POSTS

CROSS-REFERENCE TO RELATED APPLICATIONS

This application claims the benefit of U.S. provisional patent application No. 61/850,769, filed on Feb. 21, 2013, U.S. non-provisional patent application Ser. No. 14/063,882, filed on Oct. 25, 2013, and PCT application number PCT/US14/16726 filed on Feb. 17, 2014, which applications are incorporated herein by this reference in their entirety for all purposes.

BACKGROUND

Signs are commonly attached to posts. Cities, other jurisdictions, organizations and individuals take time to dig holes, pour concrete or other foundation material, and then install a post in the hole or attach it to the foundation. Additional time is then required to install signs on the posts. Because the signs and posts are outside, in weather, and are subject to contact with and by the public, they are typically made of a heavy duty material, such as a 4×4 treated wooden post or 2×2 square or round metal tube, or a 3" diameter metal tube, sometimes with anti-vandalism features, such as screws or bolts which require non-standard attachment hardware. Even when equipped with standard screws or bolts, removal of the screws or bolts takes time and the screws or bolts are subject to corrosion, which makes sign removal more difficult.

Installation of signs and posts often requires more than one person, one or more trucks, and reasonably favorable weather, such as in the summer. Unfortunately, road crews face heavy demand during periods of reasonably favorable weather and are often not available to work on signage. Signs and posts which are not in use must be stored, which, due to the bulk of the material, is another cost.

Signs commonly incorporate reflective materials, though sign posts do not commonly have a reflective surface treatment. It is often considered too labor intensive to paint a post or apply a retroreflective surface (such as reflective tape) to posts after they are installed since cleaning, drying, and treating a post prior to application of paint or a surface requires good weather, crew and equipment available for the required time, and money to pay for the crew and equipment. In addition, painting and application of a retroreflective surface may result in inconsistent results unless a strict procedure is followed.

Pre-painted or pre-surfaced posts suffer damage during storage and handling and result in increased costs. Retrofitting existing posts with a pre-painted or pre-surfaced retroreflective post is also not desirable due to the significant time and cost involved in removing posts from foundations, removing and reinstalling signs, because these activities have to take place in the relatively narrow window allowed by good weather, and because jurisdictions prefer to or may be required to deploy consistent markings throughout a fairly large area, which may preclude a piece-meal approach to existing signs and posts. Certain jurisdictions are moving away from wood posts, which are more amenable to being painted, to metal posts, which are more difficult to paint.

Sleeves have been developed for posts, though they suffer from many defects, such as that the sleeve must be installed on a post when the sign or the ground does not block passage of the sleeve onto the post or the sleeve has a circular or curvilinear horizontal cross section, which reduces the visibility of the sleeve, or the sleeve does not distinguish between four different sides of a post.

The Manual on Uniform Traffic Control Devices ("MUTCD"), issued by the Federal Highway Administration ("FHWA") of the United States Department of Transportation, defines Federal standards for traffic signs, road surface markings, and signals. Certain states in the United States have adopted the Federal standards, some with a state supplement, while other states have adopted their own standards. The MUTCD has incorporated by reference the, "Standard Highway Signs and Markings," book (FHWA) and, "Color Specifications for Retroreflective Sign and Pavement Marking Materials," ("Color Specifications") appendix to subpart F of Part 655 of Title 23 of the Code of Federal Regulations (23 C.F.R. §655). The MUTCD defines retroreflective materials and colors for use on governmentally approved signs and sign posts.

DETAILED DESCRIPTION

Figure 1:
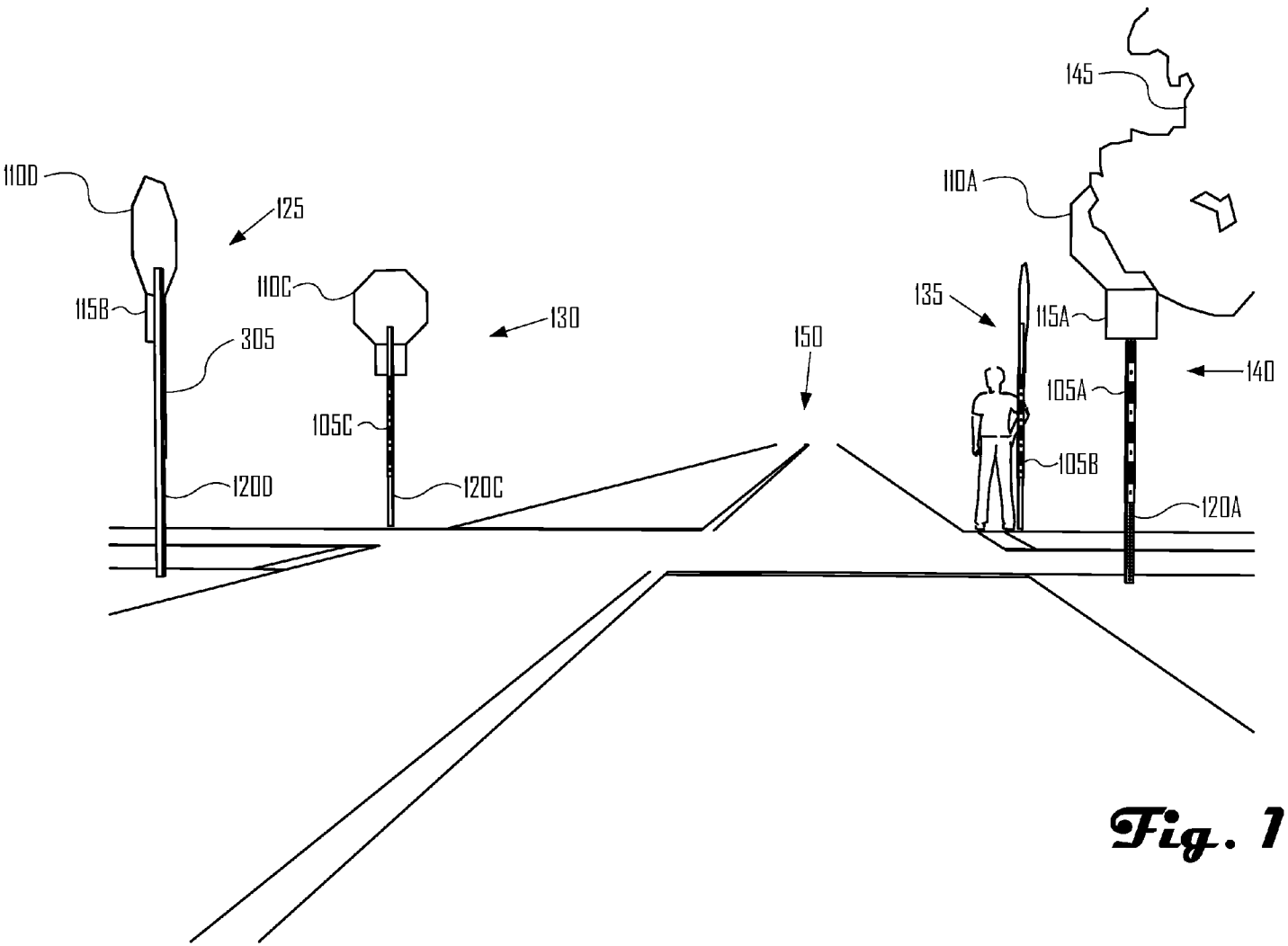
FIG. 1 is a perspective illustration of an intersection with Signs, Posts and Sleeve embodiment on the Posts, from the viewpoint of a driver in a car approaching an intersection.

The description of the drawings and the following detailed description refer to the accompanying drawings. The following description provides specific details for an understanding of various examples of the technology. One skilled in the art will understand that the technology may be practiced without many of these details. In some instances, structures and functions have not been shown or described in detail or at all to avoid unnecessarily obscuring the description of the examples of the technology. It is intended that the terminology used in the description presented below be interpreted in its broadest reasonable manner, even though it is being used in conjunction with a detailed description of certain examples of the technology. Although certain terms may be emphasized below, any terminology intended to be interpreted in any restricted manner will be overtly and specifically defined as such in this Detailed Description section.

As used herein, "releasable," "connect," "connected," "connectable," "disconnect," "disconnected," and "disconnectable" refers to two or more structures which may be connected or disconnected, generally without the use of tools (examples of tools including screwdrivers, pliers, drills, saws, welding machines, torches, irons, and other heat sources) or with the use of tools but in a repeatable manner (such as through the use of nuts and bolts or screws). As used herein, "attach," "attached," or "attachable" refers to two or more structures or components which are attached through the use of tools or chemical or physical bonding, but wherein the structures or components may not generally be released or re-attached in a repeatable manner. As used herein, "secure," "secured," or "securable" refers to two or more structures or components which are connected or attached.

As used herein, a "Post" may be a vertically oriented structure for support of a Sign. The Post may be a metal post with a continuous surface, a metal post with a surface which is pre-perforated with "punchout" holes which may be removed to accommodate a bolt (such posts are illustrated herein), or a wood post with a continuous surface. Examples of Posts illustrated in the Figures include 2"×2" square or round metal tubes, 4×4 treated wooden posts and 3" diameter metal tubes.

As used herein, a "Sign" is a substantially flat planar surface, vertically oriented, generally secured to a Post and generally for displaying communications to the public.

As used herein, components with the same element number followed by a letter ("A," "B," etc.), indicates a set of components with a substantially similar structure (within normal manufacturing tolerances). All components in such a set may be referred to without the letter.

Generally, the Sleeve embodiments disclosed herein, whether a single 3-Sided Sleeve 105 or one or more 2-Sided Sleeves 805, increase the visibility of both a Sign on a Post and the Post when viewed from two, three, or four directions. The Sleeve embodiments disclosed herein may increase visibility of a sign and post assembly in, for example, contexts in which a Sign may be obscured by vegetation, a Sign may have been damaged, or a Sign may be missing. Increasing the conspicuity of Signs and Posts reduce the chance of a Post being knocked down, reduces accidents, and reduces repair costs and legal claims for municipalities and other governmental entities. A set of Sleeves, such as two 2-Sided Sleeves 800 may be used to entirely encompass a Post, though increased visibility in all directions may be inconsistent with traffic management objectives. The 3-Sided Sleeves 105 and 2-Sided Sleeves 800 disclosed herein allow control over the directional orientation of a Sleeve, the amount of reflectivity, and the color of a Sleeve. The Sleeve embodiments are designed to accommodate a wide range of uses and situations.

The Sleeve embodiments disclosed herein may be installed quickly without removing a Sign which may already be secured to a Post, which significantly speeds up installation compared to alternatives which require removal of a Sign. The Sleeve embodiments may be quickly connected to various Posts, such as square 2" metal Posts, square 4" metal or wood Posts, or round 3" metal Posts. Connecting any of the Sleeve embodiments disclosed herein to a Post requires less human time, equipment time, and vehicle time than painting the Post or application of another surface to an existing Post. Connecting the Sleeve embodiment to a Post may be performed in a range of weather conditions, from poor to good. A Sleeve embodiment may be temporarily connected to a Post, as may be desirable in proximity to a sporting event, or permanently connected to a Post, as may be desirable for posts at an intersection where a lot of accidents occur. A large number of Sleeve embodiments may be rapidly deployed over a wide area resulting in a consistent marking scheme. The Sleeve embodiments are durable, light weight, and may be stacked or nested to take up even less space.

The Sleeve embodiments may be connected to a Post through the use of nuts and bolts, screws, nails, cable or "zip" ties, an adhesive, or the like. Additional connection components are illustrated herein. In embodiments disclosed herein, the Sleeve may be used in conjunction with a Spacer embodiment to allow the Sleeve to be connected to a smaller-sized Post. A Spacer embodiment may be hinged, to allow the hinged Spacer embodiment to be used with a range of smaller-sized posts.

The Sleeve embodiments do not present a significant wind or ice loading factor on a Post. The Sleeve embodiments do not project significantly beyond most posts, making them less subject to accidental contact with the public, intentional and unintentional prying forces, and vandalism.

The Sleeve embodiments disclosed herein comprise flat Panels. The Panels may be formed from one continuous material. The Panels may form an angle between them of approximately ninety degrees. When oriented toward the direction of travel, the Panels may be oriented to present a surface substantially perpendicular to the direction of travel. When a Sleeve embodiment comprises a retroreflective material (retroreflective materials being specified by 23 CFR 655), a Sleeve Panel oriented perpendicular to the direction of travel presents the maximum reflectivity possible. Sleeve embodiments which have a 2" horizontal dimension will comply with the minimum size requirements for retroreflective surfaces found in 23 CFR 655. If a surface on a Post were to have a round or horizontal cross-section, the surface would have to be substantially larger than 2" to comply with the minimum reflectivity requirements for retroreflective surfaces found in 23 CFR 655, because less of the round surface is oriented substantially perpendicular to the direction of travel. For example, a circular horizontal cross-section with a 2" diameter will reflect incident light by 17 degrees, which is equivalent to an effective reflective surface of only 0.58." Achieving the equivalent reflectivity of a 2" flat panel would require a circular horizontal cross-section with a 6.84" diameter.

Sleeve embodiments disclosed herein may comprise Portions; the Portions may have different colors and/or retroreflectivity allowed or required by 23 CFR 655 (hereinafter, "Portions"). The Portions may alternate. Sections of Sleeve embodiments may be removable ("Removable Sections"), to allow the Sleeve embodiment to be used with respect to a wide range of Post and Sign configurations. The Removable Sections may coincide with the Portions. The color and retroreflective material Portions may also be perforated to aid removal of the Removable Sections.

The Sleeve embodiments disclosed herein may further comprise or be accompanied by components, elements, or hardware to connect the top of one Sleeve to the bottom of another Sleeve or to connect the side of one Sleeve to the side of another Sleeve. Sleeve embodiments, Spacer embodiments, and/or attachment hardware, elements, or components may comprise an adhesive covered by a protective and removable, non-adhesive layer, to allow rapid use of these components, with or without another fastener.

FIG. 1 is a perspective illustration of an intersection with Signs (110A through 110D), Posts (120A through 120D) and Sleeve embodiments (105A through 105C and 305) on the Posts, from the viewpoint of a driver in a car approaching an intersection. Component assembly 140 in FIG. 1 illustrates a Sleeve 105A connected to a Post 120A and, also secured to the Post 120A, a Large Sign 110A, and a Small Sign 115A. FIG. 1 further illustrates roadway 150 which comprises an intersection. FIG. 1 further illustrates that Sleeve 105A increases the visibility of component assembly 140, notwithstanding that Large sign 110A is obscured by vegetation 145, and that neither the Large Sign 110A nor the Small Sign 115A are obscured by the Sleeve 105A.

Figure 3A:
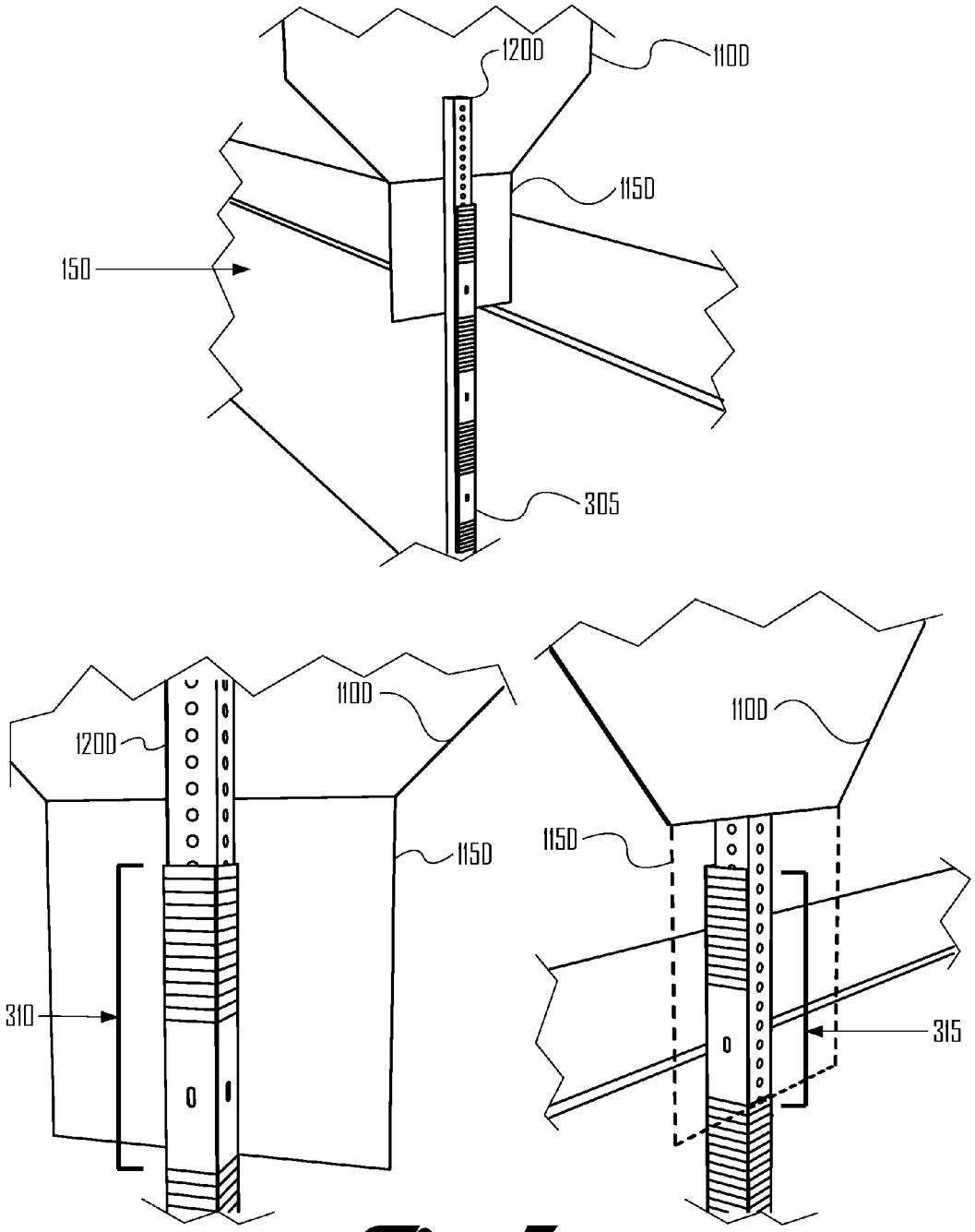
FIG. 3A presents three perspective illustrations of a Sign, Post, and three-Panel Sleeve embodiment from three different view angles, illustrating a Portion removed from the Sleeve to accommodate a Sign.

Component assemblies 130 and 135 in FIG. 1 illustrate the same or a similar Sleeve (the same or similar as 105A, with Sleeves 105B and 105C), while another embodiment of Sleeve 305 is illustrated on component assembly 125 (Sleeve 305 is further illustrated in FIG. 3A). FIG. 1 illustrates that Sleeve 105 and Sleeve 305 have three sides, that the three sides may be secured to the Posts 120 with a side oriented substantially toward the viewer in the proximate road lane and with the missing side oriented toward a road lane which is perpendicular relative to the orientation of the Sign 110 and Post 120 on which the Sleeve 105 or 305 is mounted.

Component assembly 125 illustrates that the Sleeve 305 is difficult to view on the side of component assembly 125 facing the viewer, because there is no flat surface of Sleeve 305 oriented substantially toward the viewer. In contrast, the Sleeves 105 on the other Posts 120 (such as Sleeve 105A on component assembly 140, Sleeve 105B on component assembly 135 and Sleeve 105C on component assembly 130) do have a surface oriented substantially toward the viewer and are more visible; this reinforces the stop condition which pertains to the intersection. Traffic design objectives and/or requirements for a particular jurisdiction may favor an approach such as this. FIG. 1 illustrates how Sleeve embodiments 105 and 305 may be used to selectively improve the visibility of the Sign and Post assemblies at an intersection.

Figure 2:
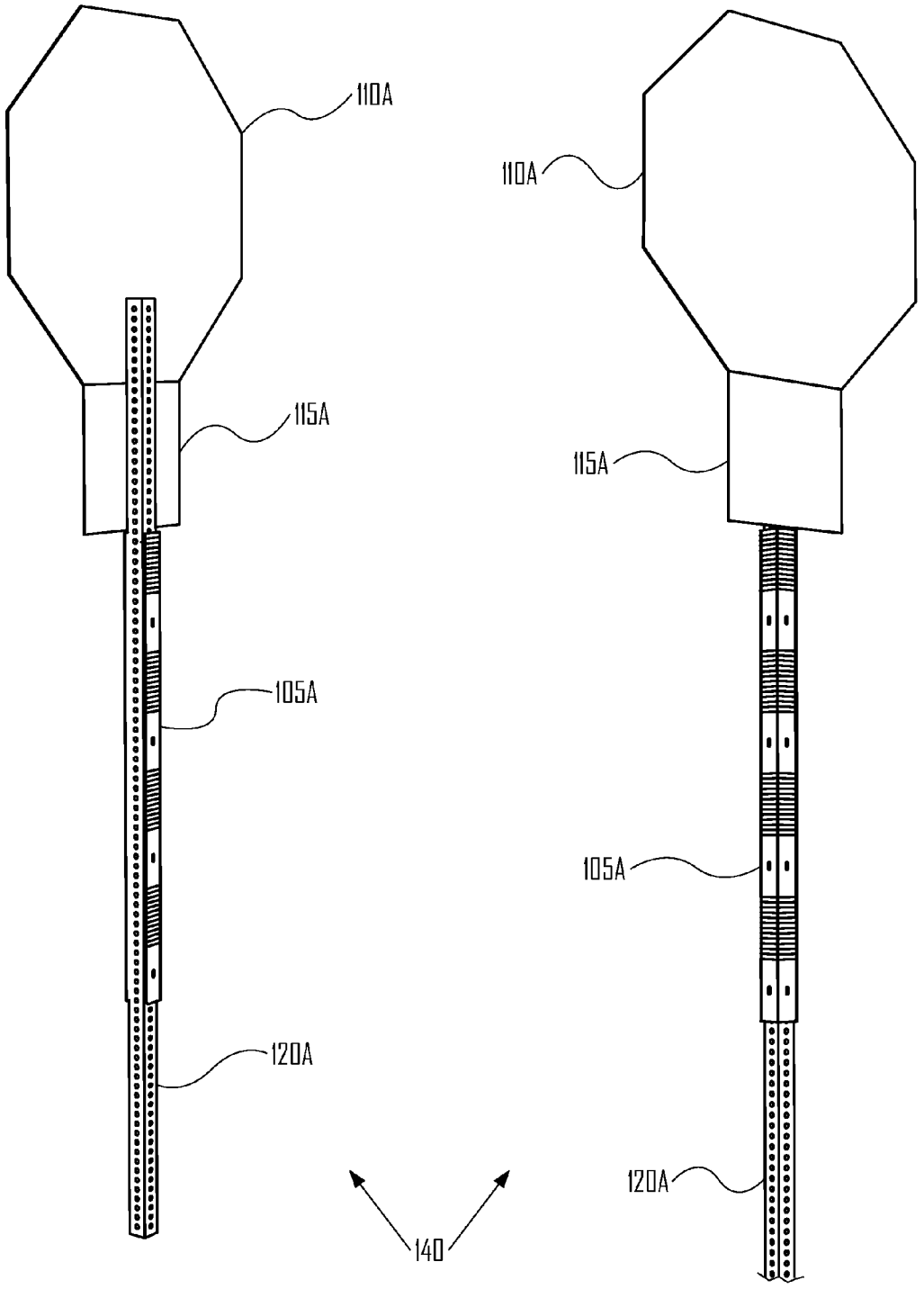
FIG. 2 presents two perspective illustrations of a Sign, Post, and a three-Panel Sleeve embodiment from two different view angles.

FIG. 2 presents two perspective illustrations of component assembly 140, showing Sign 110A, Post 120A, and three-Panel Sleeve 105A from two different view angles and without the other elements in FIG. 1. FIG. 2 illustrates that one side of the Post 120A is not covered by the Sleeve 105A.

FIG. 3A presents three perspective illustrations of a Sign 110D, Post 120D, and three-Panel Sleeve 305 from three different view angles, illustrating a Section 315 removed from the Sleeve 305 to accommodate the Small Sign 115D. FIG. 3A illustrates Sections 310 and 315 of Sleeve 305, and that Section 315 has been removed (or was otherwise not present) to accommodate Small Sign 115D, while allowing the visibility benefits of Sleeve 305 to extend up beyond the bottom of Small Sign 115D.

Figure 3B:
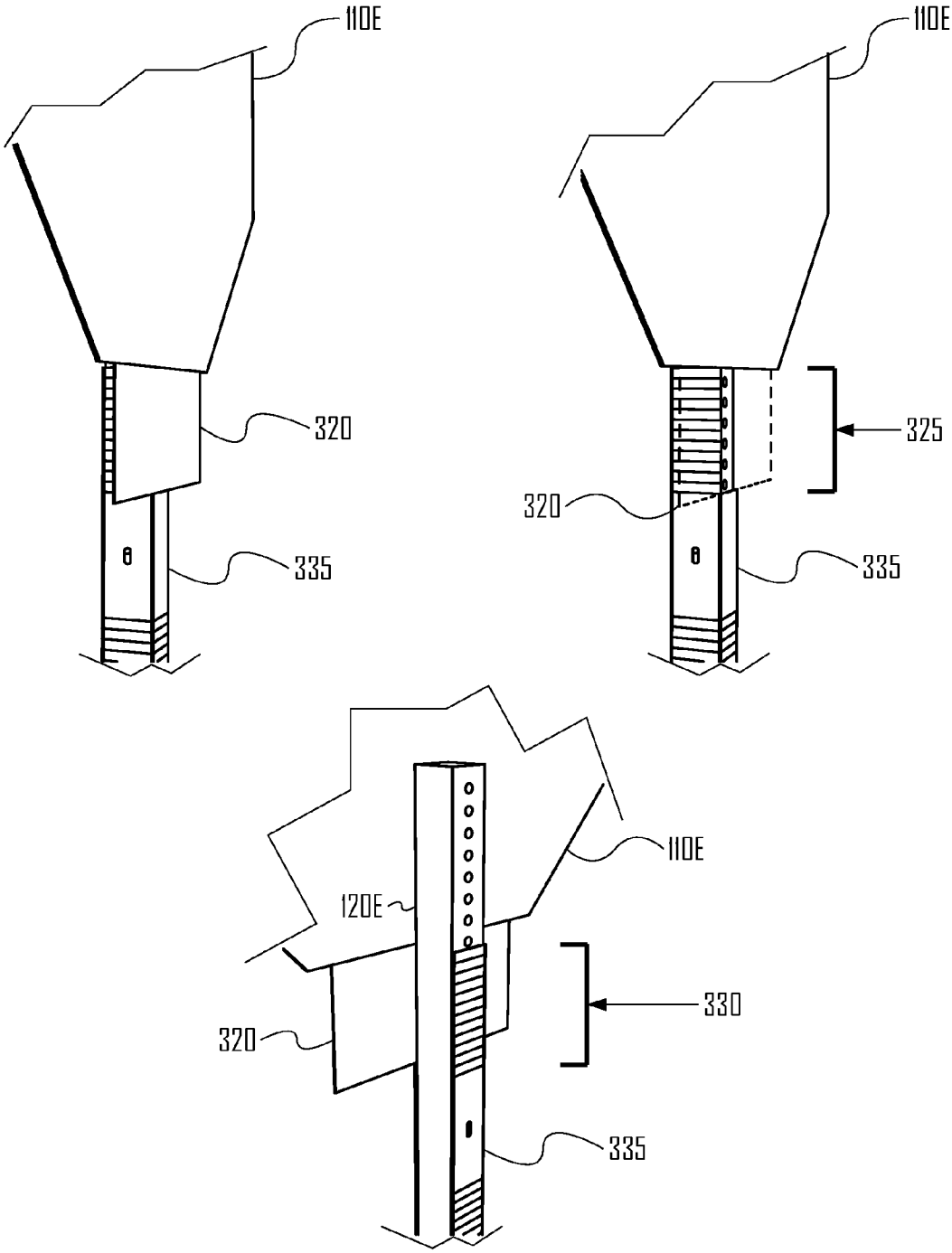
FIG. 3B presents three perspective illustrations of a Sign, Post, and three-Panel Sleeve embodiment from three different view angles, illustrating a Section removed from the Sleeve to accommodate a Sign, which Sign and removed Section is smaller than as illustrated in FIG. 3A.

FIG. 3B presents three perspective illustrations of a Sign 110E, a Smaller Sign 320, a Post 120E, and three-panel Sleeve 335 from three different view angles, illustrating a Section 325 removed from the Sleeve 335 to accommodate the Smaller Sign 320, which Smaller Sign 320 and removed Section 325 is smaller than as illustrated in FIG. 3A. FIG. 3B illustrates that Small Sign 320, and Section 325 have been removed (or were otherwise not present), leaving Section 330 on the side of the Post opposite the Smaller Sign 320 intact. The dimensions of the Smaller Sign 320 in FIG. 3B are, for example, 12" by 6" while Section 325 is 6" high. FIGS. 3A and 3B illustrate the ability of Sleeve embodiments to accommodate a range of Signs.

Figure 4:
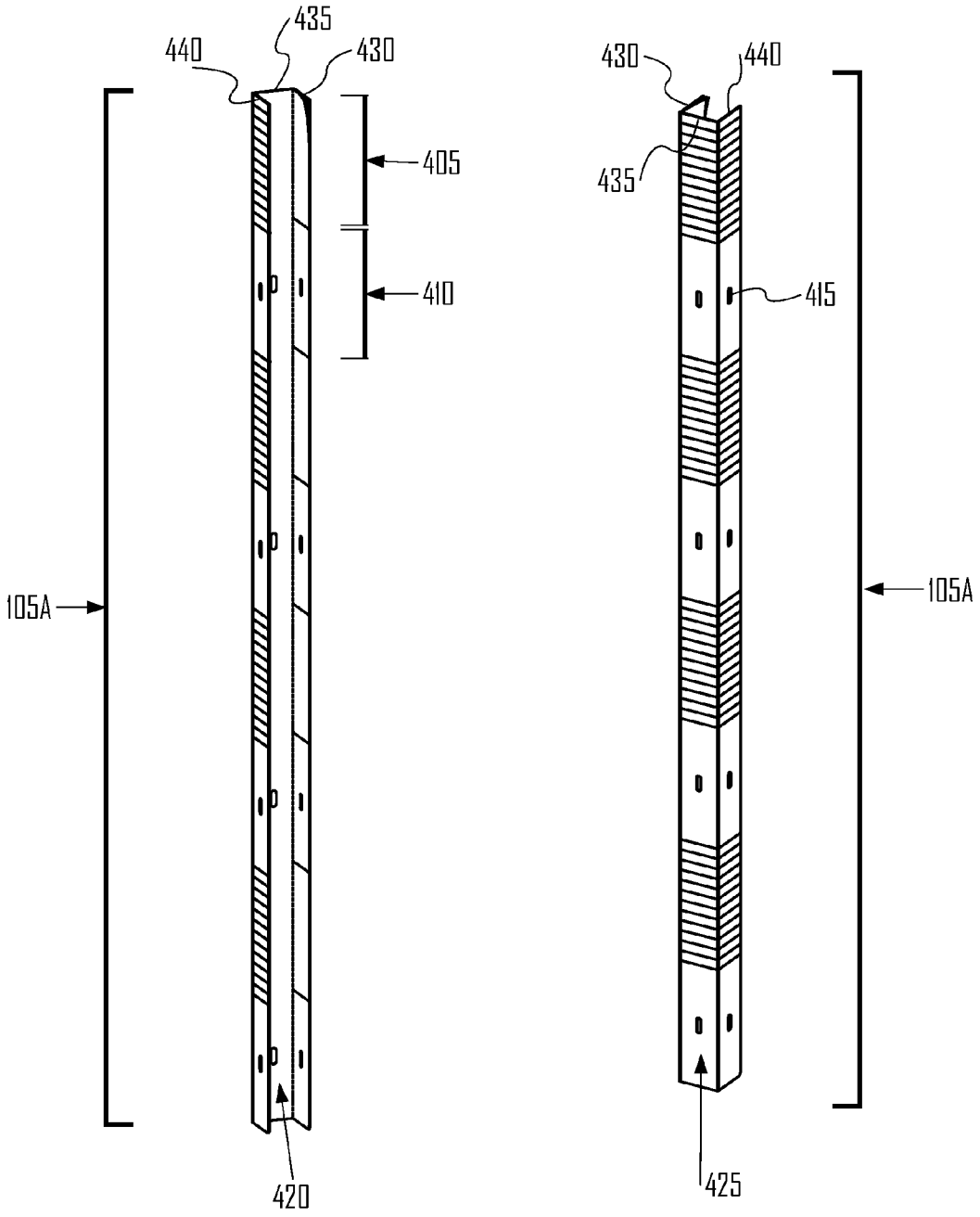
FIG. 4 presents two perspective illustrations of a three-Panel Sleeve embodiment from two different view angles.

FIG. 4 presents two perspective illustrations of the three-Panel Sleeve 105A from two different view angles to illustrate details of the Sleeve 105A. In FIG. 4, Sleeve 105A is illustrated as comprising Panels 430, 435, and 440, as well as Connector Hole 415 (only one of which is numbered), through which connection hardware, such as a screw, bolt, nail, or cable tie may be passed. FIG. 4 further illustrates Interior Area 420, between the Panels, and Exterior Area 425, external to the Panels. FIG. 4 further illustrates Portion 405 and Portion 410. Portion 405 is lined to indicate that a color, retroreflective material, or similar may be found in or on this Portion 405, and that Portion 405 may be visually distinguishable from Portion 410. Which of Portions 405 and 410 are colored, or with what color, or are retroreflective, etc., is not as significant as that Portions 405 and 410 may be visually distinguishable. Additional details of Sleeve 105A are illustrated in FIG. 7.

Figure 5:
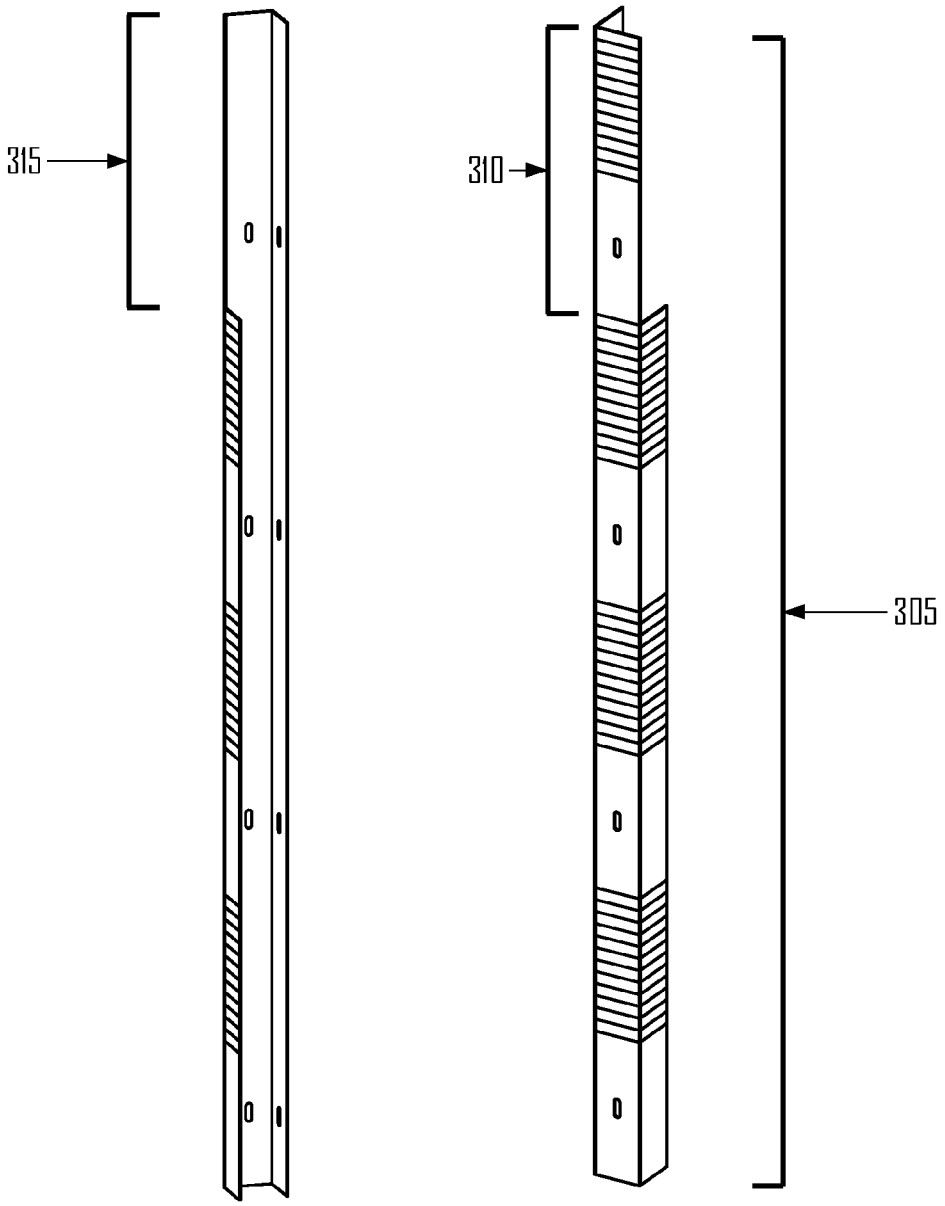
FIG. 5 presents two perspective illustrations of a three-Panel Sleeve embodiment from two different view angles.

FIG. 5 presents two perspective illustrations of the three-Panel Sleeve 305 from two different view angles to illustrate details of the Sleeve 305. FIG. 5 illustrates that Section 315 has been removed or is otherwise not present, such as if the Sleeve 305 were manufactured without a Panel in Section 315, whereas the Panels are present in the area of Section 310.

Figure 6:
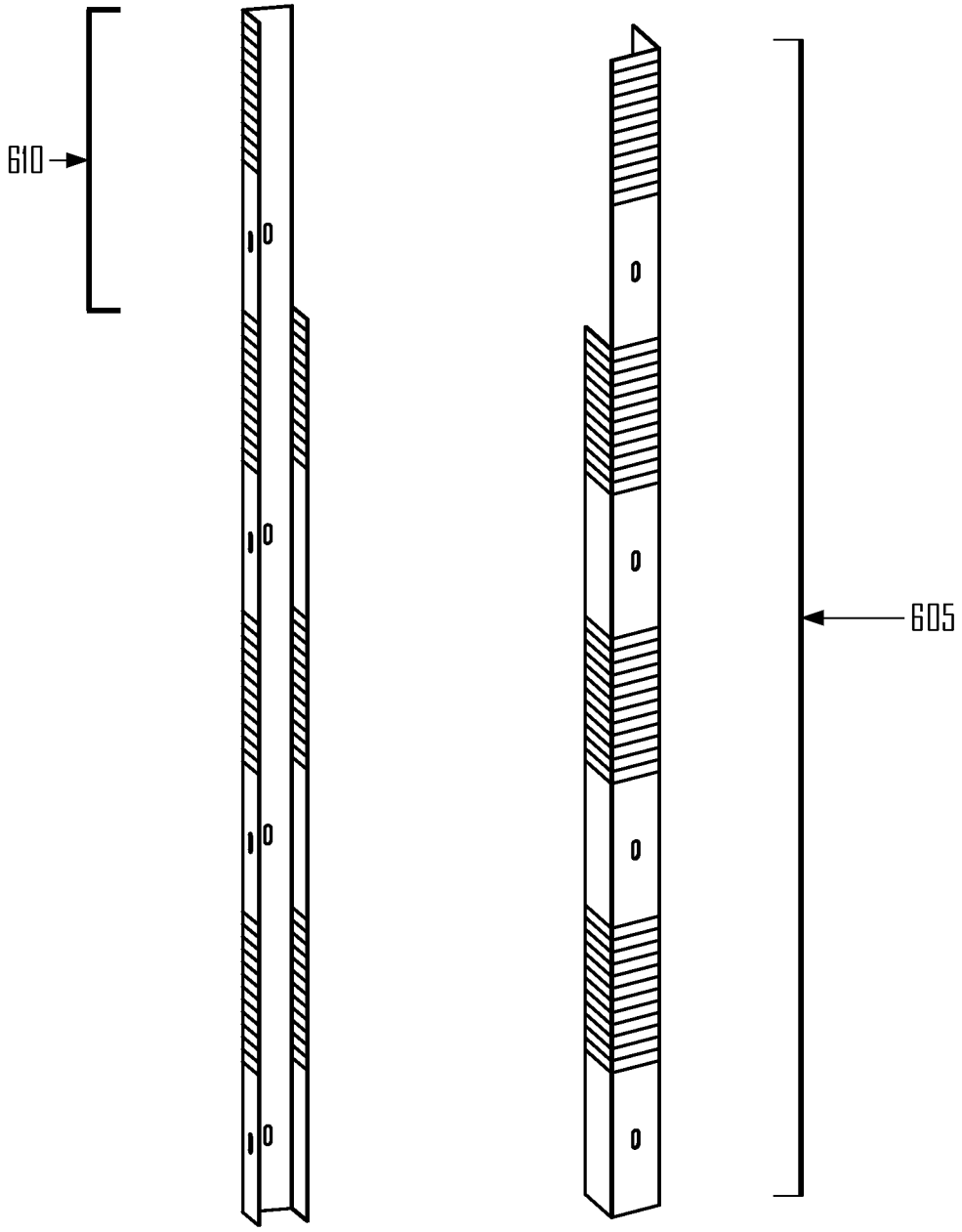
FIG. 6 presents two perspective illustrations of a three-Panel Sleeve embodiment from two different view angles.

FIG. 6 presents two perspective illustrations of a three-Panel Sleeve 605 from two different view angles to illustrate details of the Sleeve. FIG. 6 differs from FIG. 5, inasmuch as the Section 610 which is retained or otherwise present is on the opposite side from Section 315. FIGS. 5 and 6 illustrate that Sections, such as Sections 315 and 610, may be removed from or otherwise not be present on a Sleeve (whether 305 or 605), and that the removed Sections may be on opposite sides.

Figure 7:
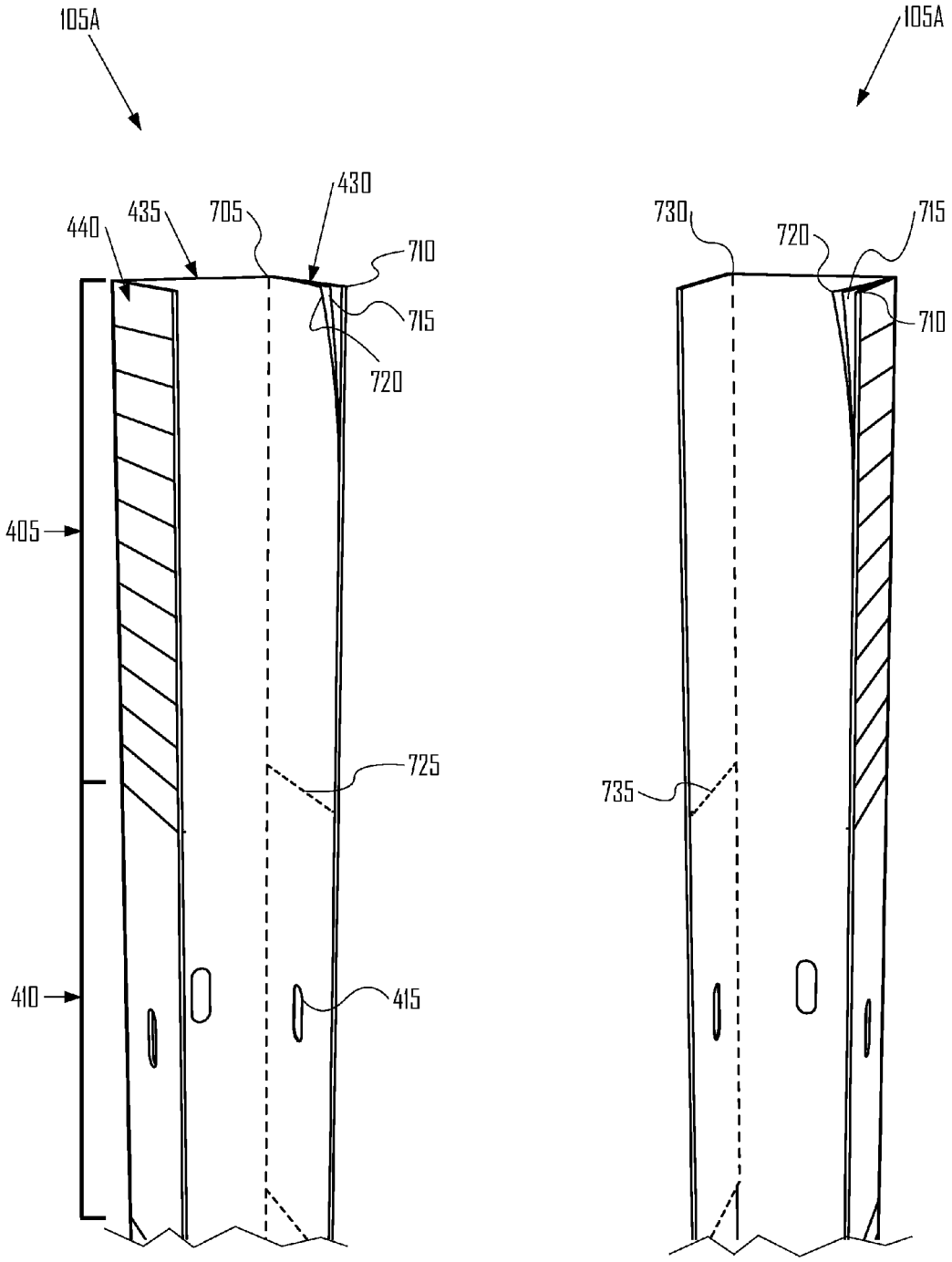
FIG. 7 presents two perspective illustrations of close views of a three-panel Sleeve embodiment from two different view angles.

FIG. 7 presents two perspective illustrations of close views of a three-panel Sleeve 105A from two different view angles to illustrate details of the Sleeve 105A. FIG. 7 illustrates grooves, perforations, scoring, partial cuts, thinning, or otherwise weakened lines along Groove 705, Groove 725, and Groove 735. The Grooves in FIG. 7 are illustrated as being coextensive with the Portions 405 and 410 on the external surface of the Sleeve 105A, though in an alternative embodiment, the Grooves 705, 725, and 735 may not be coextensive with the Portions 405 and 410. The Grooves 705, 725, and 735 allow areas, such as Portions 405 and 410 and corresponding Removable Sections, to be broken off or otherwise separated from the Sleeve 105A. Alternatively, one of the Grooves 705, 725, and 735 may allow a Removable Section corresponding to Portion 405 and 410 to be bent along the Groove, such as to bend the Removable Section within the interior area of the Sleeve 105A and then, when the Sleeve 105A is secured to a Post, the Removable Section bent within the interior area of the Sleeve 105A will lay substantially flat and will be hidden from view. At least one of Panels 430, 435, and 440 may not have Grooves, which leaves the un-grooved Panel stronger, in this instance, Panel 435. The Grooves may only be in the rigid Sleeve material and/or may be through a retroreflective and/or colored layer, allowing the retroreflective and/or colored surface to be cleanly removed along with the area encompassed by the Groove.

FIG. 7 further illustrates that the Sleeve 105A may comprise an Adhesive Layer 715, adhered to the Base 710 of the Sleeve, and a Protective Layer 720 lightly adhered to the Adhesive Layer 715. In use, the Protective Layer 720 may be peeled off of the Adhesive Layer 715 (leaving the Adhesive Layer 715 adhered to the Base 710), allowing the Sleeve 105A to be adhered to a Post, to another Sleeve, to a Spacer, or a Connector. This may be desirable on a temporary basis, such as to allow the Sleeve 105A to be held in place long enough for connection hardware, such as a nail, screw, or bolt to be passed through a Hole, such as Hole 415, or on a more permanent basis.

Figure 8:
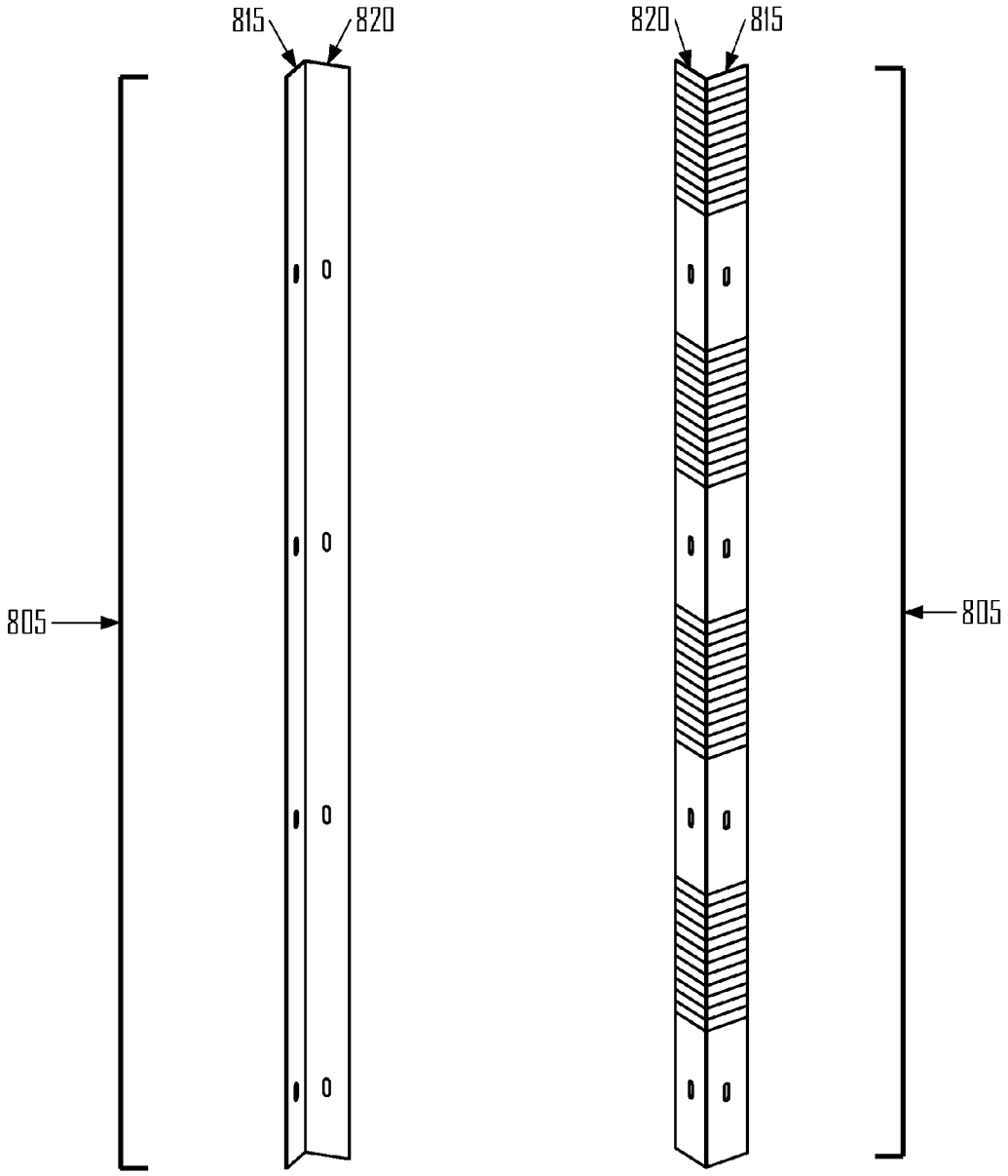
FIG. 8 presents two perspective illustrations of a two-panel Sleeve embodiment from two different view angles.

FIG. 8 presents two perspective illustrations of a two-panel Sleeve 805 from two different view angles to illustrate details of the Sleeve 805. FIG. 8 illustrates that the Sleeve 805 may comprise two Panels, 815 and 820.

Figure 9:
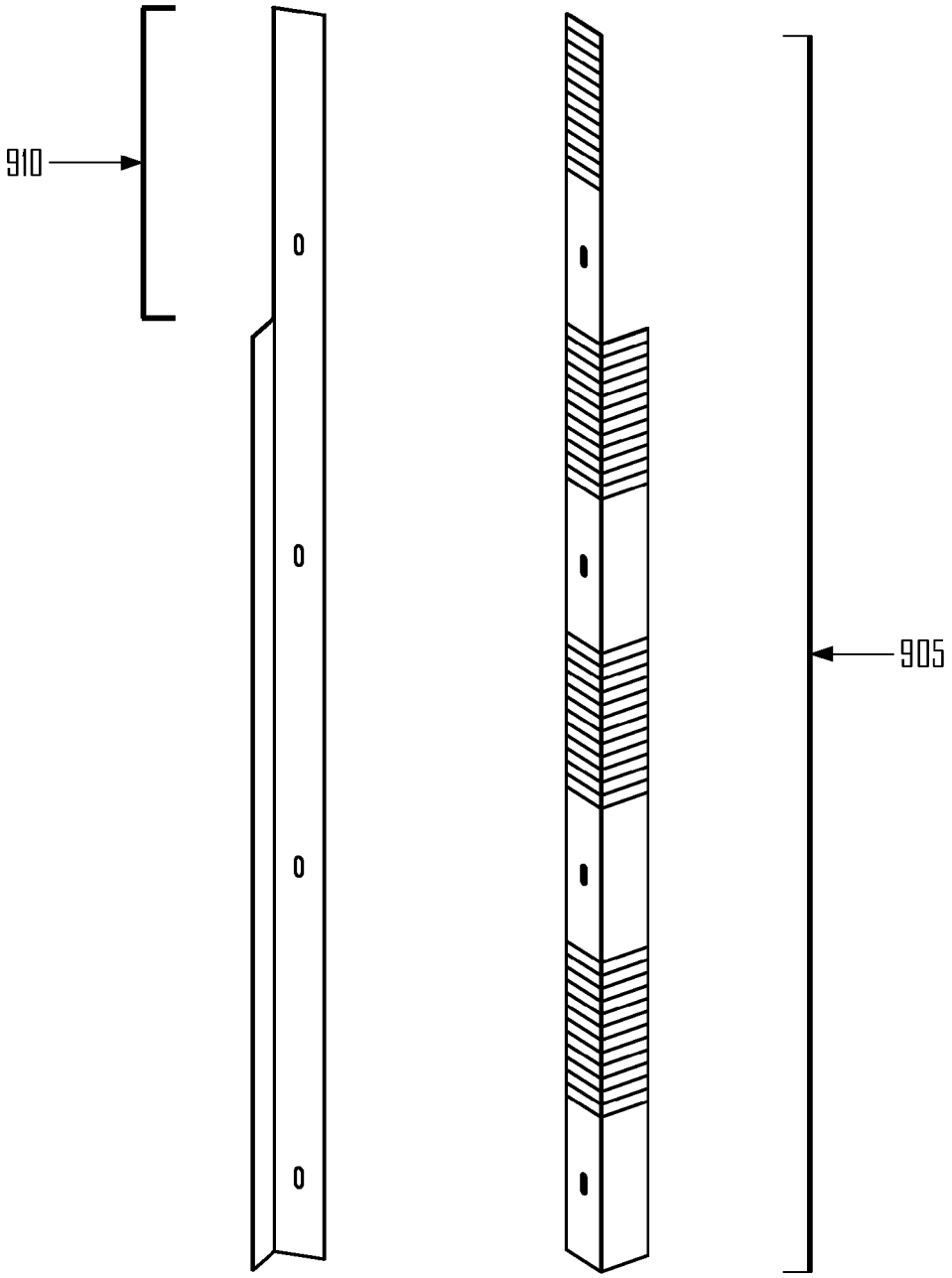
FIG. 9 presents two perspective illustrations of a two-Panel Sleeve embodiment from two different view angles.

FIG. 9 presents two perspective illustrations of a two-Panel Sleeve 905 from two different view angles to illustrate details of the Sleeve 905. FIG. 9 illustrates that Section 910 has been removed or is otherwise not present, such as if the Sleeve 905 were manufactured without a Panel in Section 910.

Figure 10:
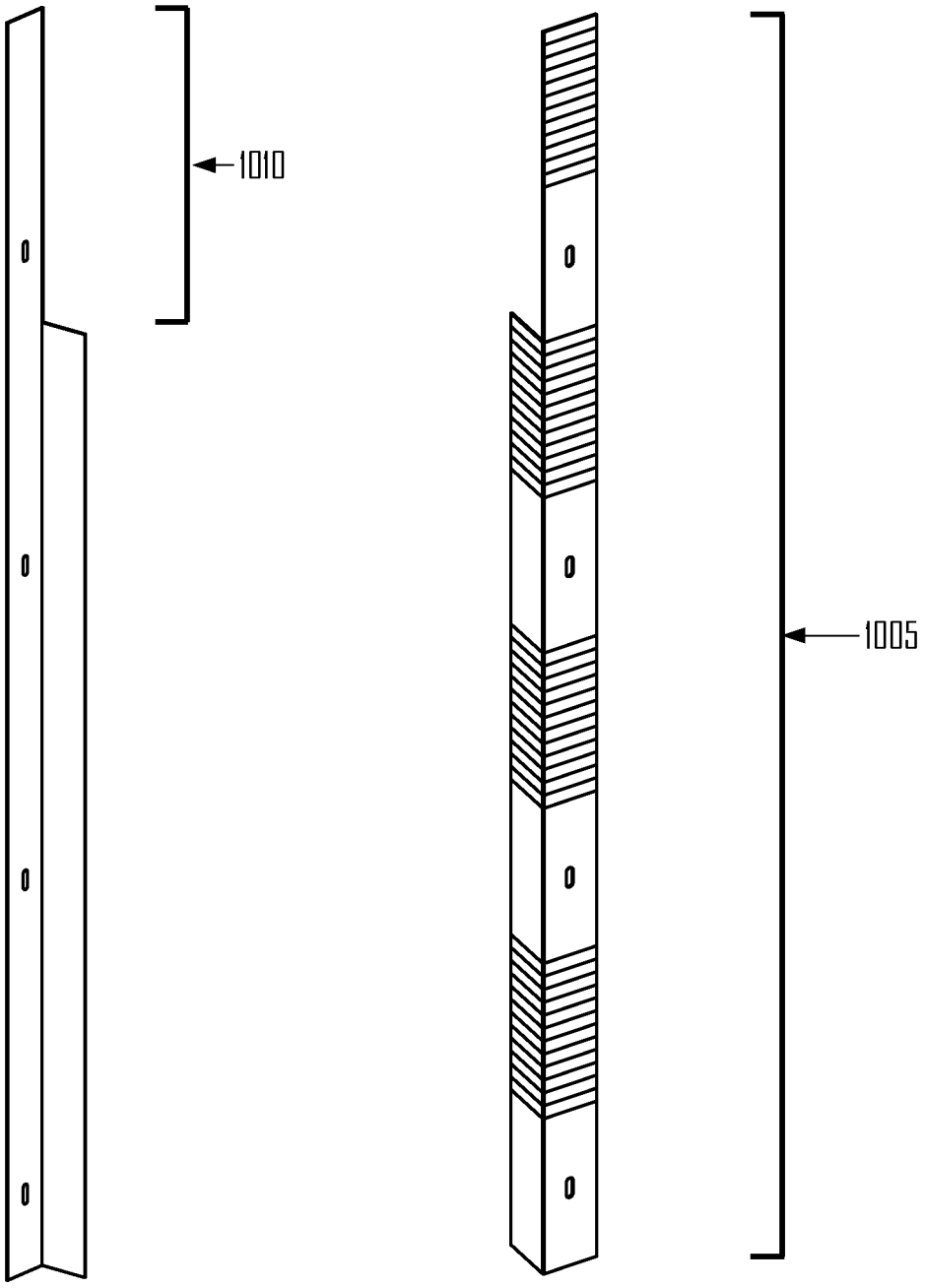
FIG. 10 presents two perspective illustrations of a two-Panel Sleeve embodiment from two different view angles.

FIG. 10 presents two perspective illustrations of a two-Panel Sleeve 1005 from two different view angles to illustrate details of the Sleeve 1005. FIG. 10 differs from FIG. 9, inasmuch as the Section 1010 which is removed or otherwise not present is on the opposite side from Section 910. FIGS. 9 and 10 illustrate that Sections 910 and 1010 may be removed from or otherwise not be present on a two-Panel Sleeve (905 or 1005), and that the Sections may be on opposite sides.

Figure 11:
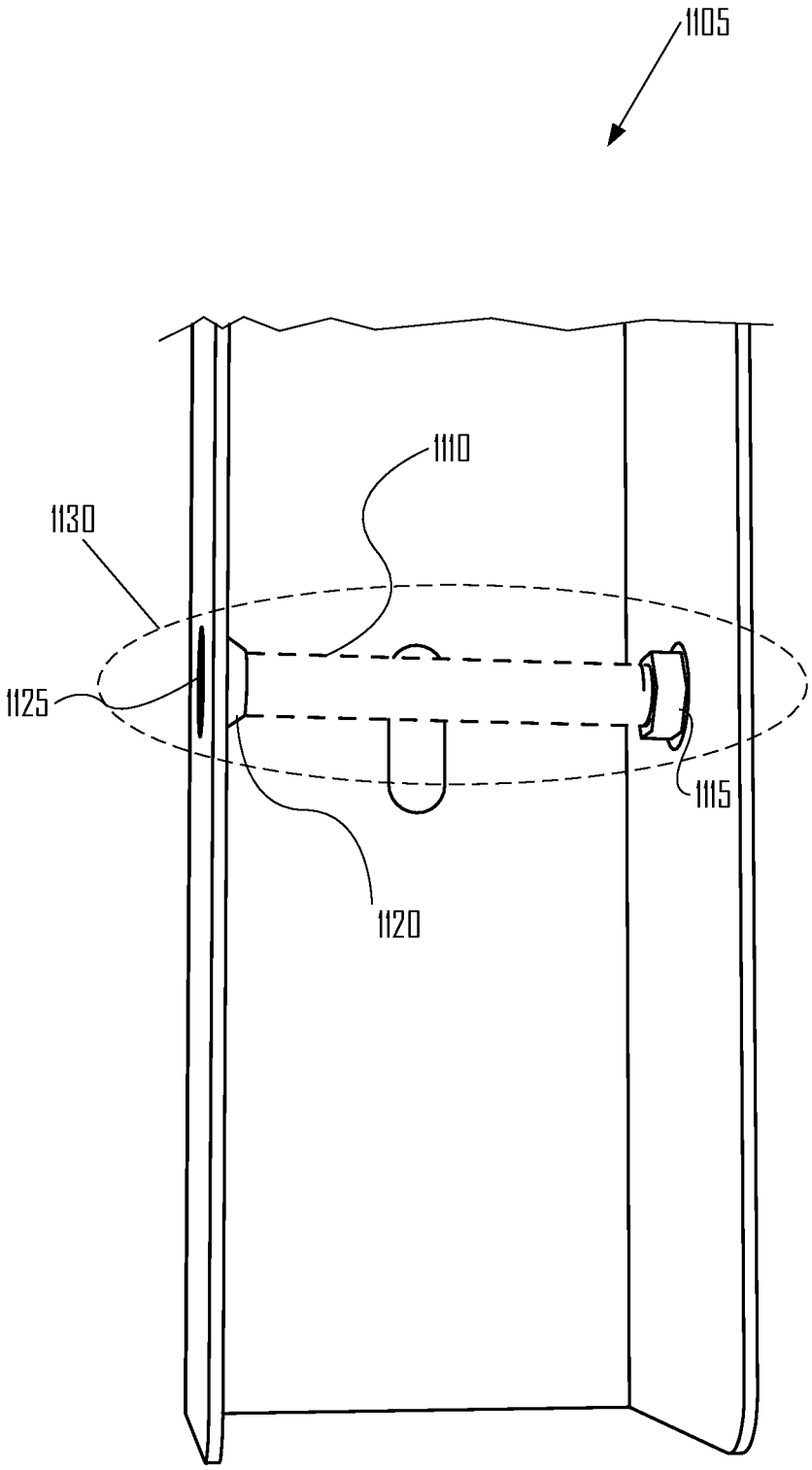
FIG. 11 presents a perspective illustration of a three-Panel Sleeve embodiment and an example of a first Bushing and connection hardware.

FIG. 11 presents a perspective illustration of a three-Panel Sleeve 1105 illustrating an embodiment of a Bushing 1130 and connection hardware. In this embodiment, the Bushing 1130 comprises a Threaded Nut 1115, a Seat 1120, and a Recessed Opening 1125. The Threaded Nut 1115 and Seat 1120 may be sized to fit within, for example, a 7/16" diameter punchout hole in a Post. Installation of the three-Panel Sleeve 1105 would proceed by flexing the Sleeve 1105 to open it slightly and allow it to fit around the Post. When the Threaded Nut 1115 and Seat 1120 are positioned over the punchout holes in the Post (which have been punched out), the Sleeve 1105 may be allowed to close to its normal shape, such that the Threaded Nut 1115 and Seat 1120 are within the punchout holes. Connection hardware, such as Bolt 1110 may then be passed through Seat 1120 and then screwed into Threaded Nut 1115. Seat 1120 may be a recessed aperture which allows a flat-head bolt (such as Bolt 1110) to be screwed into Threaded Nut 1115, leaving minimal projection on the side of the Seat 1120.

Figure 12:
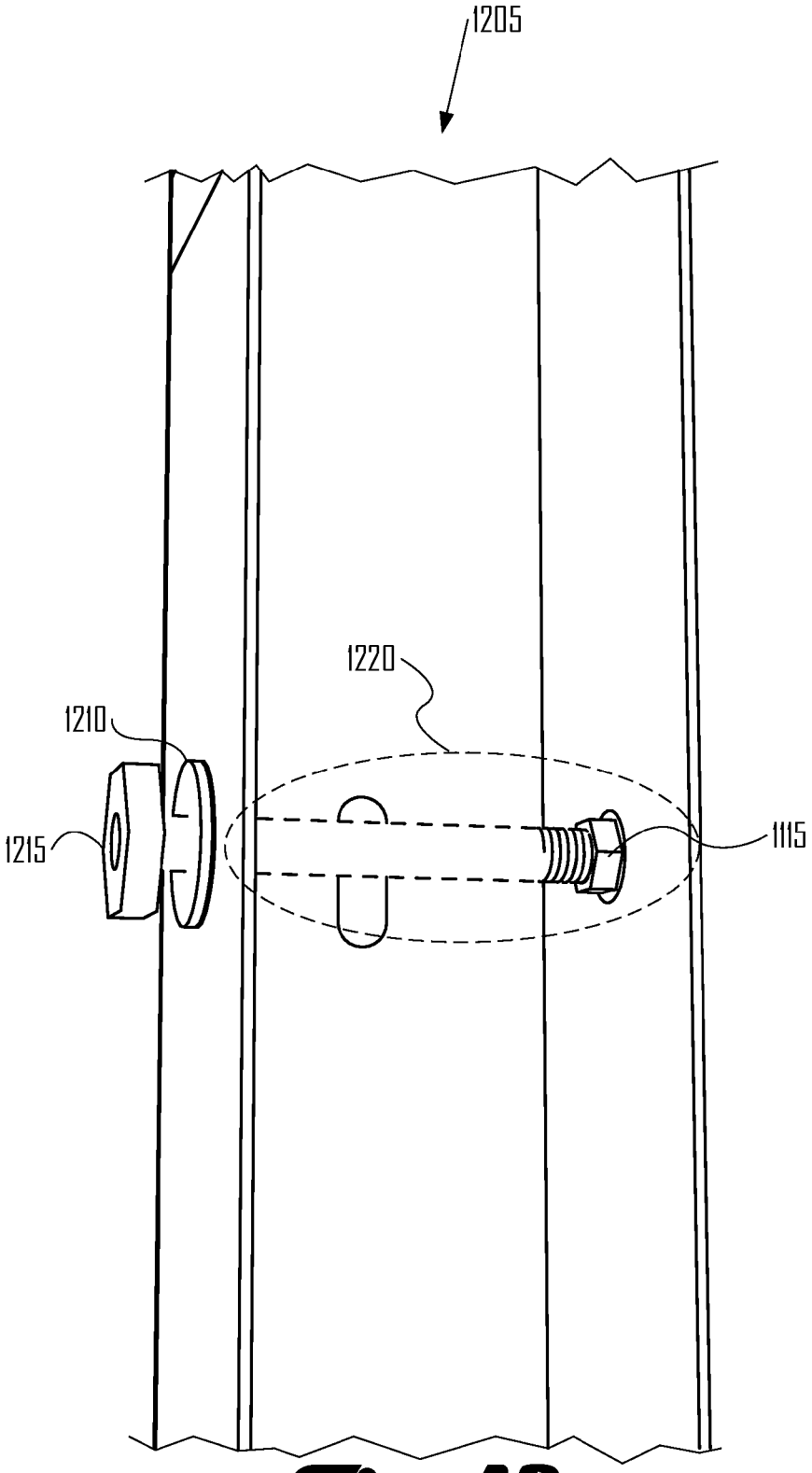
FIG. 12 presents a perspective illustration of a three-Panel Sleeve embodiment and an example of a second Bushing and a connection hardware.

FIG. 12 presents a perspective illustration of a three-Panel Sleeve 1205 illustrating an embodiment of a Bushing 1220 and a connection hardware. In this embodiment, the Bushing 1220 comprises Threaded Nut 1115. A hole similar to Hole 415 may lie underneath Washer 1210. Connection hardware such as Bolt 1215 may pass through the Hole and screw into Threaded Nut 1115. The Threaded Nut 1115 may be used as described above with respect to FIG. 11.

Figure 13:
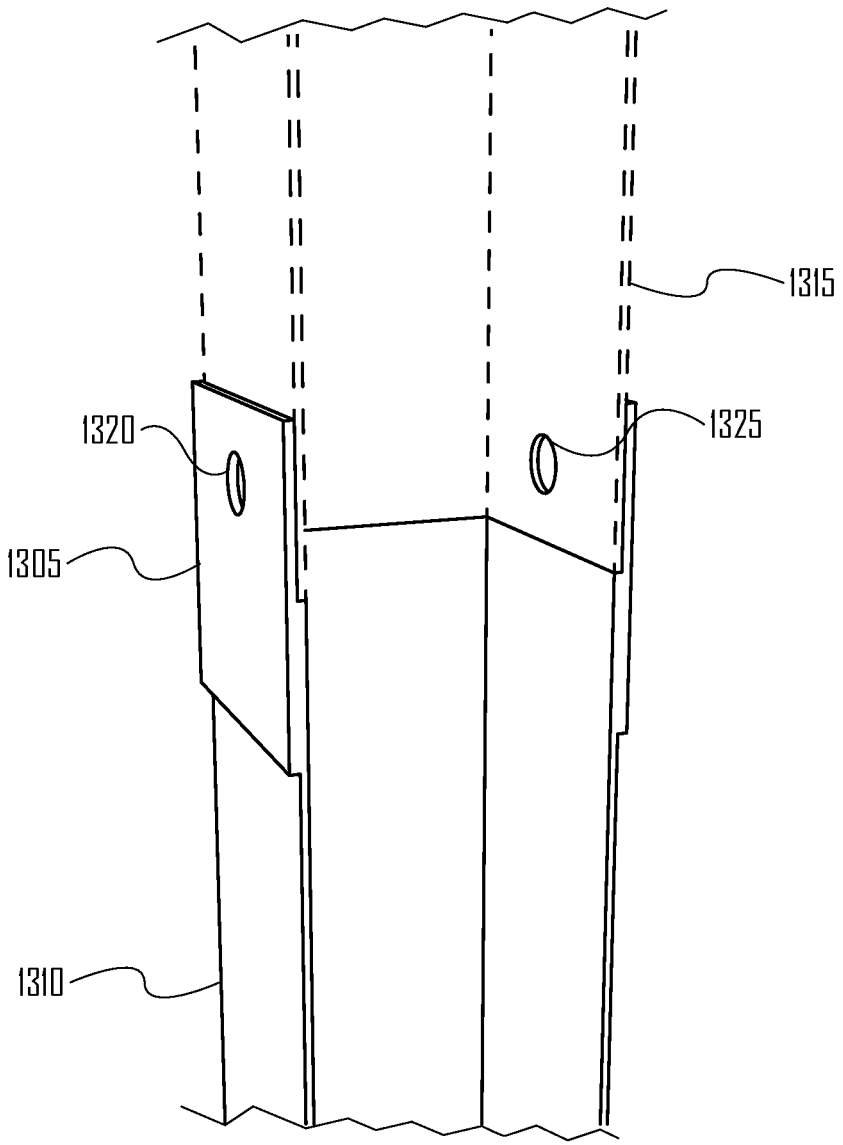
FIG. 13 presents a perspective illustration of a first three-Panel Sleeve presented in solid line and a second three-Panel Sleeve presented in dotted line, illustrating an embodiment of a top-bottom Connector between the two sleeves.

FIG. 13 presents a perspective illustration of a first three-Panel Sleeve 1310 presented in solid line and a second three-Panel Sleeve 1315 presented in dotted line, illustrating an embodiment of a top-bottom Connector or Flange 1305 between the two Sleeves. The three-Panel Sleeve 1310 comprises the Connector or Flange 1305, which may be sized to accommodate second three-Panel Sleeve 1315. An adhesive layer or area may be present on the interior of the Flange 1305. Two or more Sleeves 1310 may then be connected, the top of one to the bottom of another. Connection hardware, such as a bolt, may be passed through Hole 1320, through a corresponding Hole in Sleeve 1315, through or into a Post and, optionally, through Hole 1325 in Sleeve 1315, and then through another Hole in Flange 1305.

Figures 14A, 14B:
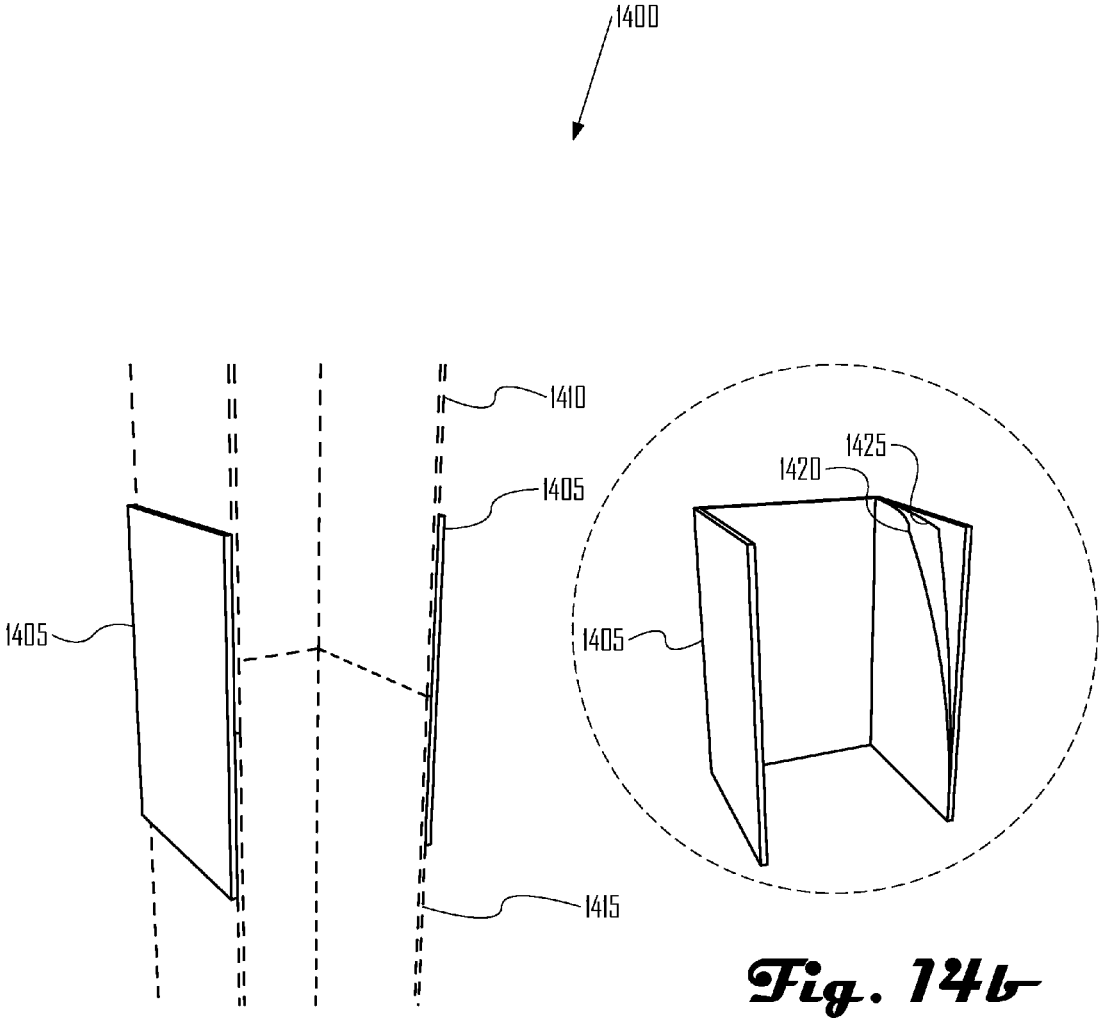
FIGS. 14A and 14B present a perspective illustration of an embodiment of a three-Panel Sleeve top-bottom Connector presented in solid line and two three-Panel Sleeves presented in dotted line.

FIG. 14A presents a perspective illustration of an embodiment of a three-Panel Sleeve top-bottom Connector 1405 presented in solid line and two three-Panel Sleeves 1410 and 1415 presented in dotted line. Sleeves 1410 and 1415 abut beneath Connector 1405. Connector 1405 may comprise a Hole, such as Hole 1320 to accommodate connection hardware. The Connector 1405 is also illustrated in FIG. 14B as comprising Adhesive Layer 1425 and Protective Layer 1420. The Protective Layer 1420 may be peeled back to allow Adhesive Layer 1425 to be adhered to Sleeves 1410 and 1415, temporarily, such as to facilitate deployment of connection hardware, or semi-permanently.

Figure 15:
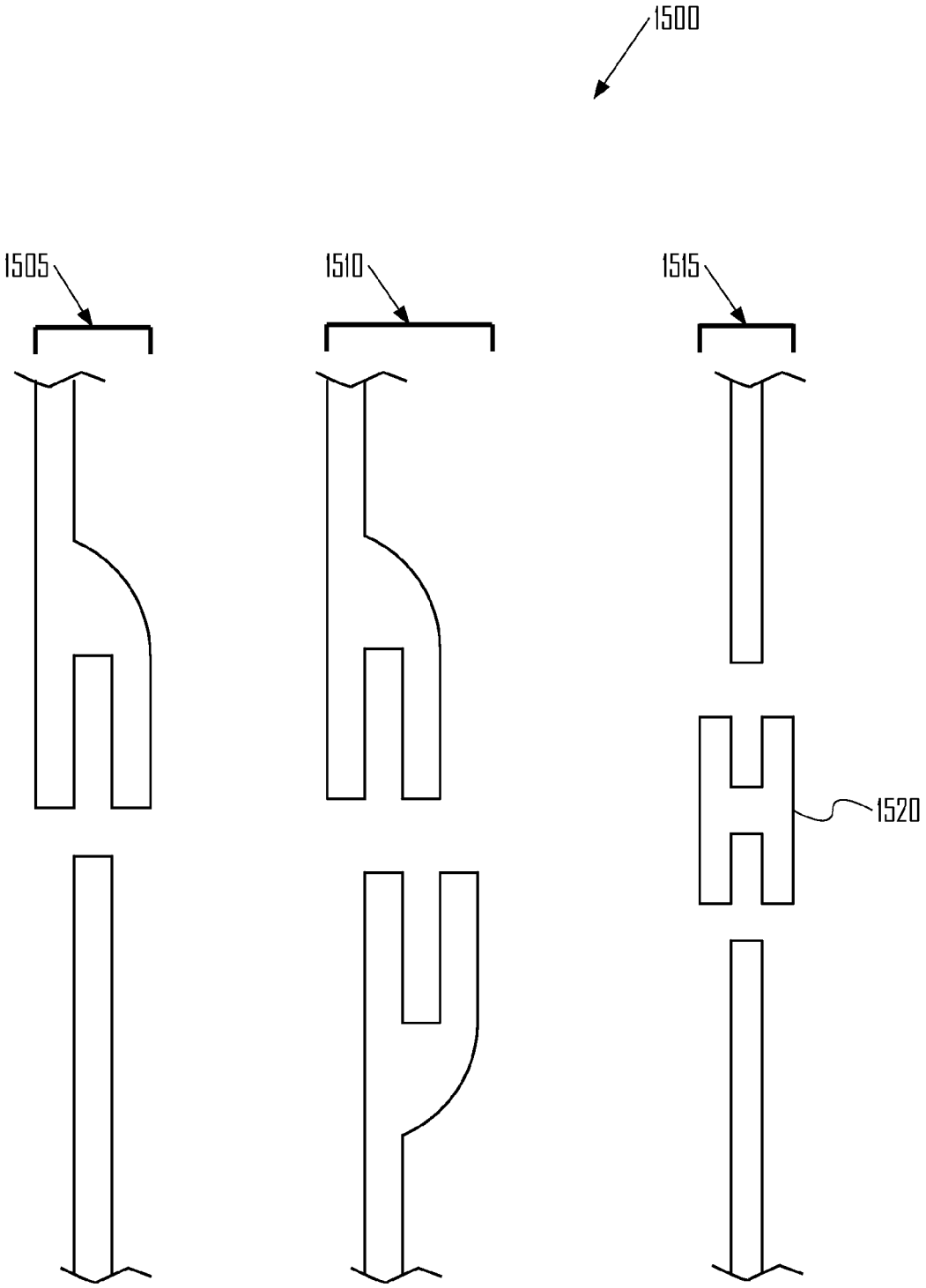
FIG. 15 illustrates three embodiments of top-bottom Sleeve Connectors, illustrating vertical cross-sections of two Sleeves.

FIG. 15 illustrates three embodiments of top-bottom Sleeve Connectors, 1505, 1510, and 1515, illustrating vertical cross-sections of two Sleeves. In these embodiments, Connector embodiment 1505 is asymmetric, inasmuch as the top of one Sleeve in the pair is not the same as the bottom of the other Sleeve in the pair. Embodiment 1510 is symmetric, inasmuch as the top of one Sleeve is the same as the bottom of the other. Embodiment 1515 comprises symmetric Sleeves and a symmetric Connector 1520.

Figure 16:
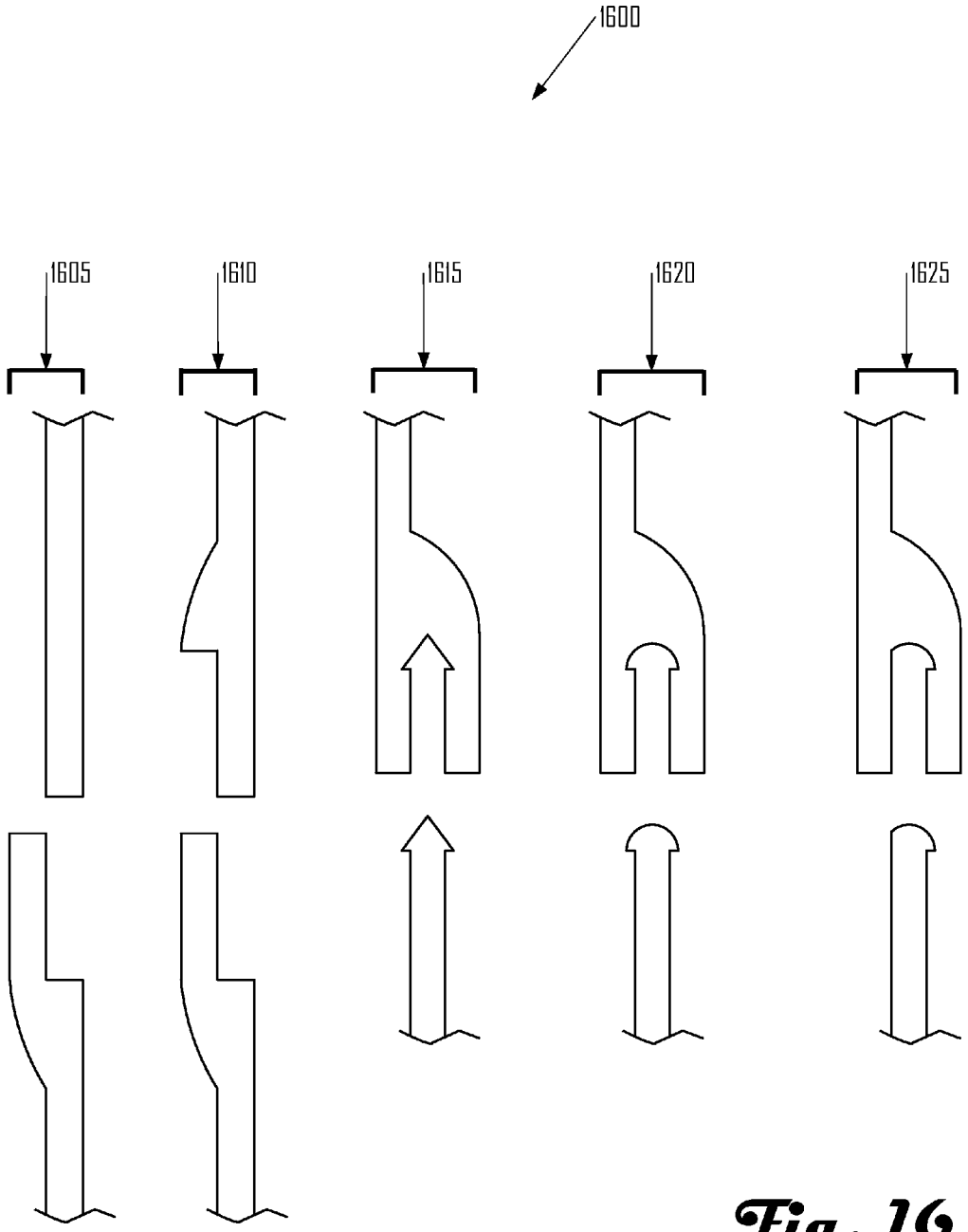
FIG. 16 illustrates five embodiments of top-bottom Sleeve Connectors, illustrating vertical cross-sections of two Sleeves.

FIG. 16 illustrates five embodiments of top-bottom Sleeve Connectors, 1605-1625, illustrating vertical cross-sections of two Sleeves. None of these embodiments are symmetric.

Figure 17:
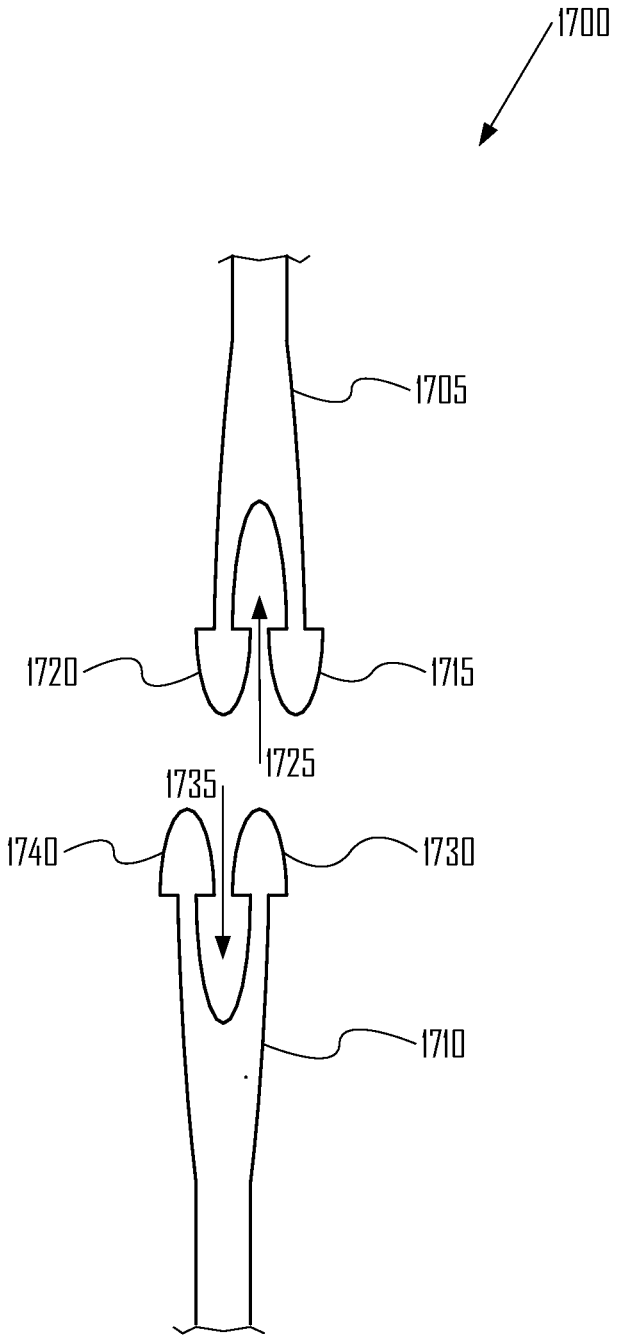
FIG. 17 illustrates one embodiment of a top-bottom Sleeve Connector, illustrating a vertical cross-section of two Sleeves.

FIG. 17 illustrates one embodiment of a top-bottom Sleeve Connector, illustrating a vertical cross-section of two Connectors 1705 and 1710. In this embodiment, the Connector 1705 comprises Male Projections 1715 and 1720 and Female Space 1725, while Connector 1710 comprises Male Projections 1730 and 1740 and Female Space 1735. Male Projection 1730 may be made to pass into Female Space 1725, connecting Sleeves attached to these Connectors.

Figure 18:
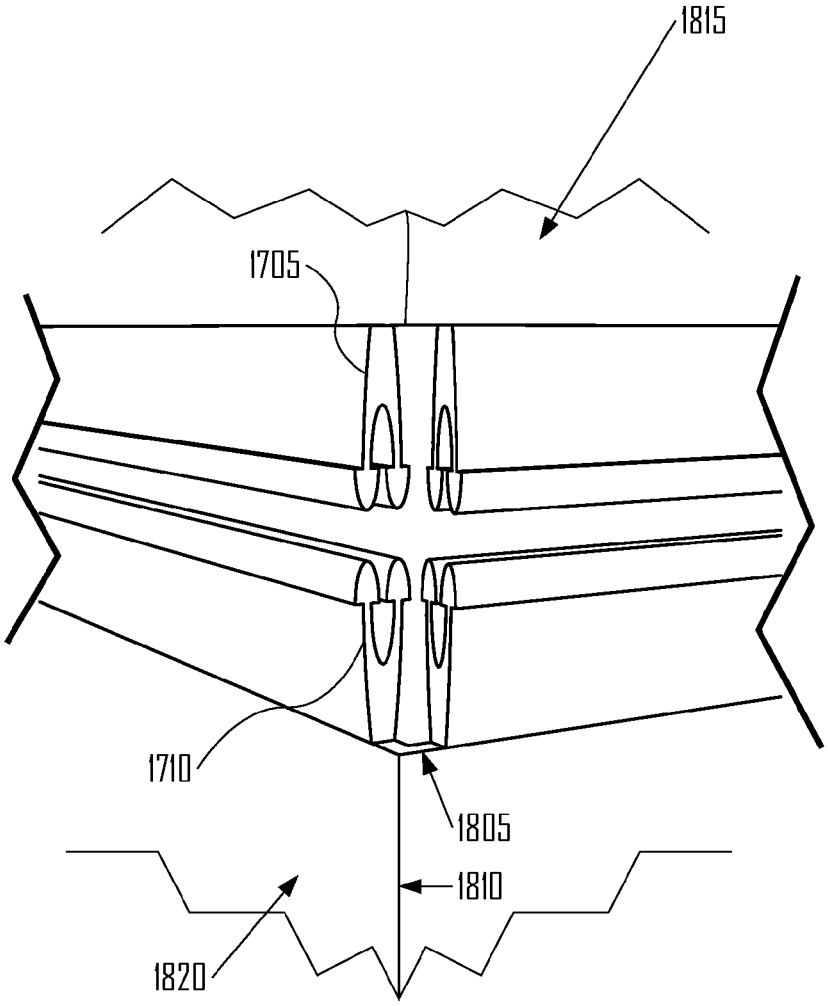
FIG. 18 illustrates the top-bottom Sleeve Connector illustrated in FIG. 17, in a perspective view illustrating a corner of the two Sleeves.

FIG. 18 illustrates the top-bottom Sleeve Connectors 1705 and 1710 illustrated in FIG. 17, in a perspective view illustrating a corner of two Sleeves 1815 and 1820. In this Figure, Sleeve 1815 comprises Connector 1705 and Sleeve 1820 comprises Connector 1710. The Sleeves 1815 and 1820 further comprise gaps, such as Gap 1805 at the Corner 1810 of each Sleeve, which Gap is provided to allow the Connectors to be connected without regard to alignment of the Male Projections between the Sleeves.

Figure 19:
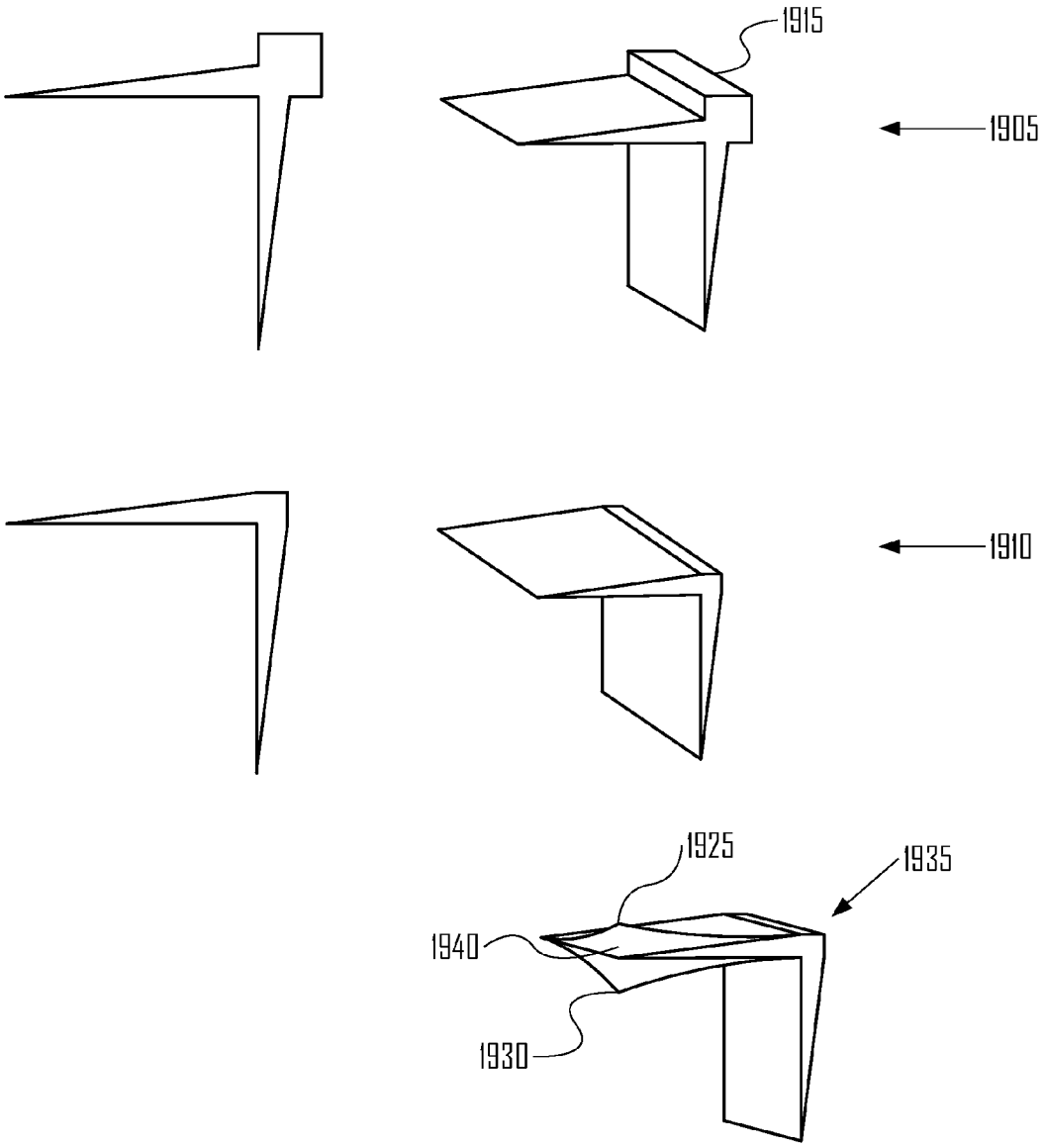
FIG. 19 illustrates two embodiments of side-to-side Sleeve Connectors, each in top and orthogonal views.

FIG. 19 illustrates two embodiments of side-to-side Sleeve Connectors 1905 and 1910, each in top and orthogonal views. The Connectors 1905 and 1910 may be used to connect the long axis or edge of one Sleeve to the edge of another Sleeve. Connector 1905 comprises a Backstop 1915 against which the Sleeve edges may be seated. As illustrated by Connector 1935, this style of Connector may further comprise an Adhesive Layer 1940 beneath Protective Layers 1925 and/or 1930, allowing the Connector 1935 to be adhered to a Post and/or one or two Sleeves.

Figure 20:
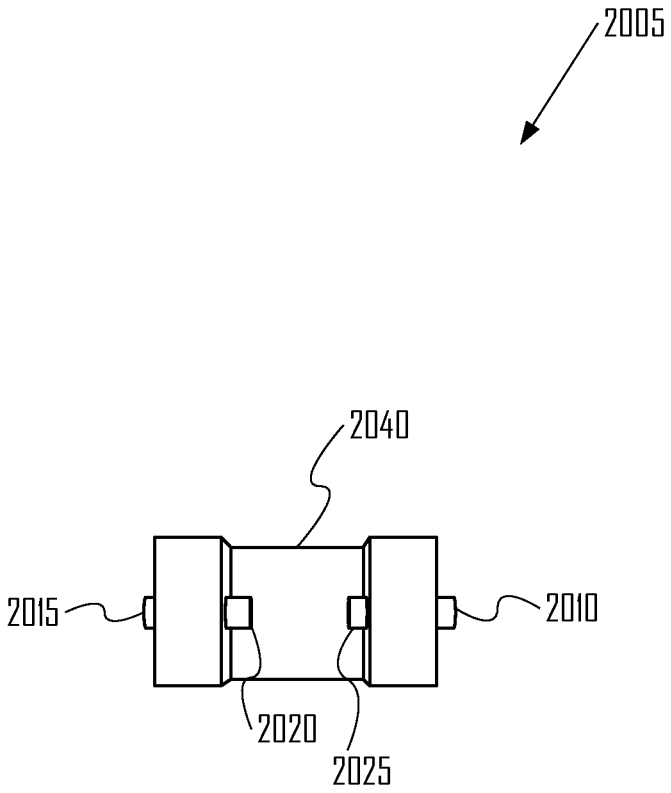
FIG. 20 illustrates a perspective view of a Sleeve-Post Spacer embodiment.

FIGS. 20 through 23 may be viewed together, in sequence. FIG. 20 illustrates a perspective view of a Sleeve-Post Spacer 2005 embodiment. The Spacer 2005 may comprise a U-shaped rigid material, such as closed cell foam, such as polystyrene. The Spacer 2005 may comprise Nubs 2010, 2015, 2020, and 2025. The Nubs may be sized to fit within punchout openings in a Post and the Holes in a Sleeve. The Nubs may hold the Spacer 2005 and Sleeve on a Post until connection hardware, such as a screw or bolt, is pushed into and through the Nubs. The Nubs may be fabricated to be removable from the Spacer 2005, such as by being broken off with fingers or with connection hardware (such as when connection hardware is screwed into the Spacer 2005).

Figure 21:
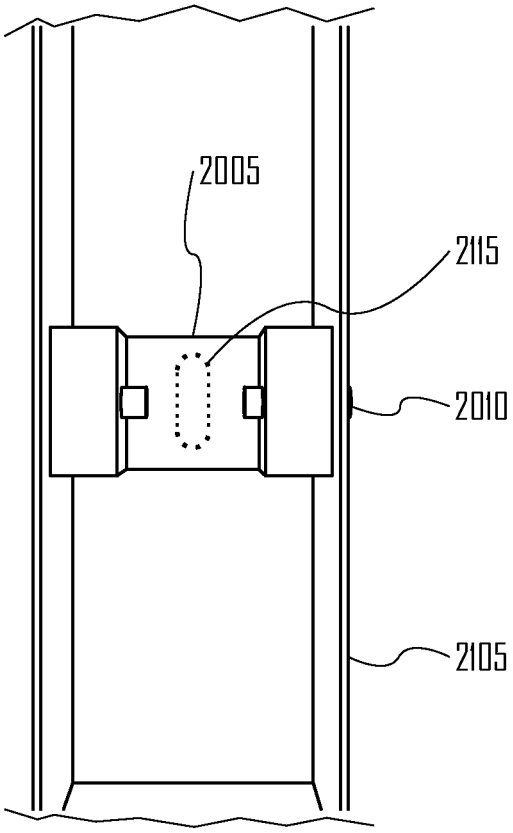
FIG. 21 illustrates a perspective view of the Sleeve-Post Spacer embodiment illustrated in FIG. 20, further illustrating a Sleeve.
Figure 22:
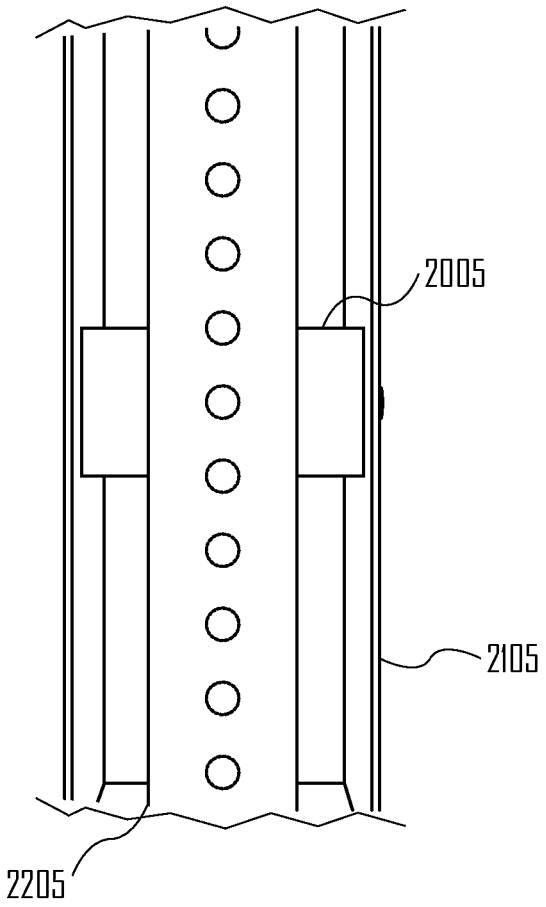
FIG. 22 illustrates a perspective view of the Sleeve-Post Spacer embodiment illustrated in FIG. 20, further illustrating a Sleeve and a square horizontal cross-section Post.
Figure 23:
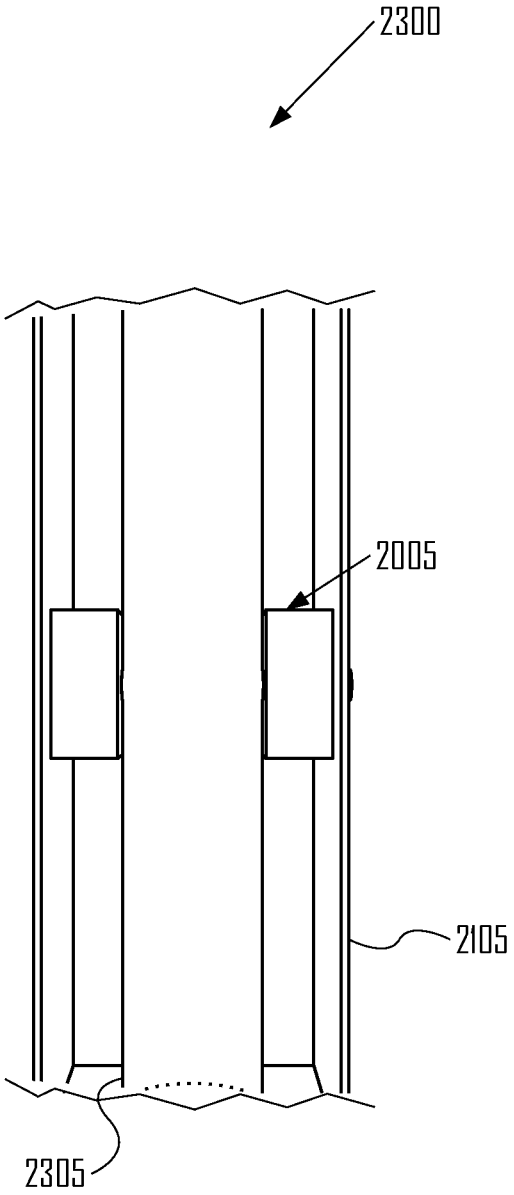
FIG. 23 illustrates a perspective view of the Sleeve-Post Spacer embodiment illustrated in FIG. 20, further illustrating a Sleeve and a circular horizontal cross-section Post.

FIG. 21 illustrates a perspective view of the Sleeve-Post Spacer 2005 embodiment illustrated in FIG. 20, further illustrating a Sleeve 2105. This Figure illustrates that Nub 2010 fits through a Hole in the Sleeve 2105; this Hole is not shown, but is substantially similar to Hole 2115 (which is shown in dotted line, because it is behind Sleeve-Post Spacer 2005). FIG. 22 illustrates a perspective view of the Sleeve-Post Spacer 2005 embodiment illustrated in FIG. 20, further illustrating Sleeve 2105 and a square horizontal cross-section Post 2205. FIG. 23 illustrates a perspective view of the Sleeve-Post Spacer 2005 embodiment illustrated in FIG. 20, further illustrating Sleeve 2105 and a circular horizontal cross-section Post 2305.

Figure 24:
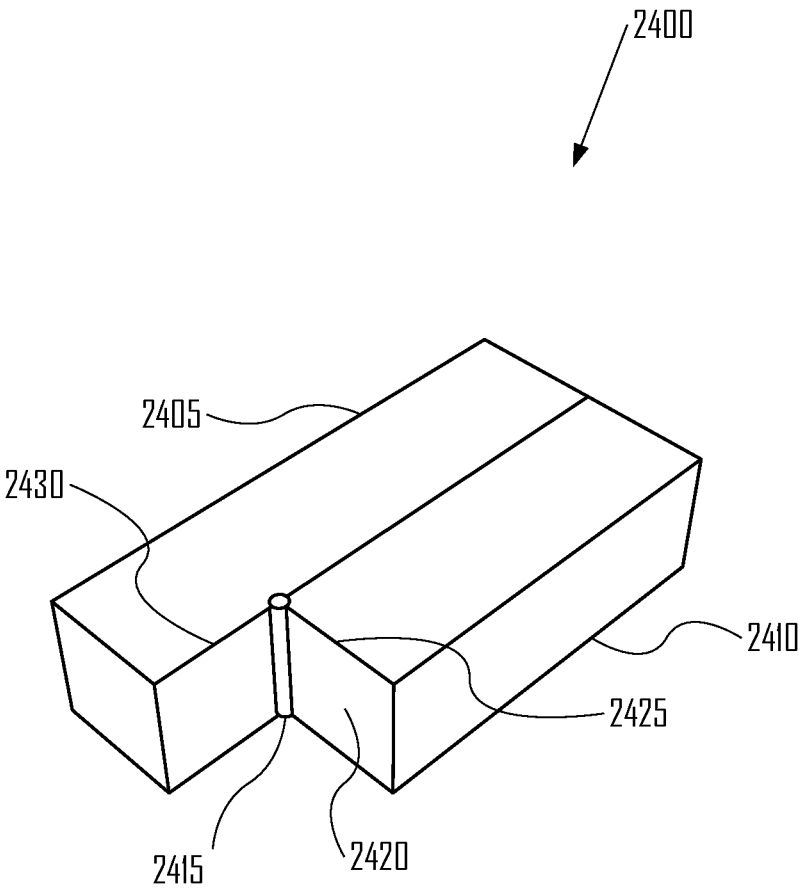
FIG. 24 illustrates a three-quarter perspective view of a hinged Sleeve-Post Spacer embodiment.

FIG. 24 illustrates a three-quarter perspective view of a hinged Sleeve-Post Spacer 2400 embodiment. This Spacer 2400 embodiment is illustrated as comprising a first Block 2405 and a second Block 2410. The Blocks are secured by Hinge 2415. Hinge 2415 may comprise, for example, a piece of Fabric 2420 adhered to both Block 2405 and 2410 (see also FIG. 28), and/or a hardware hinge. A cylinder is illustrated at element 2415 to embody various alternatives. The Hinge 2415 may be located a distance back from Block 2405 (element 2430) equal to the width of Block 2410 (element 2425), allowing Block 2410 to be deployed and come to rest forming a generally flat plain with the end of Block 2405, roughly in an "L" shape. See also FIG. 28.

Figure 25:
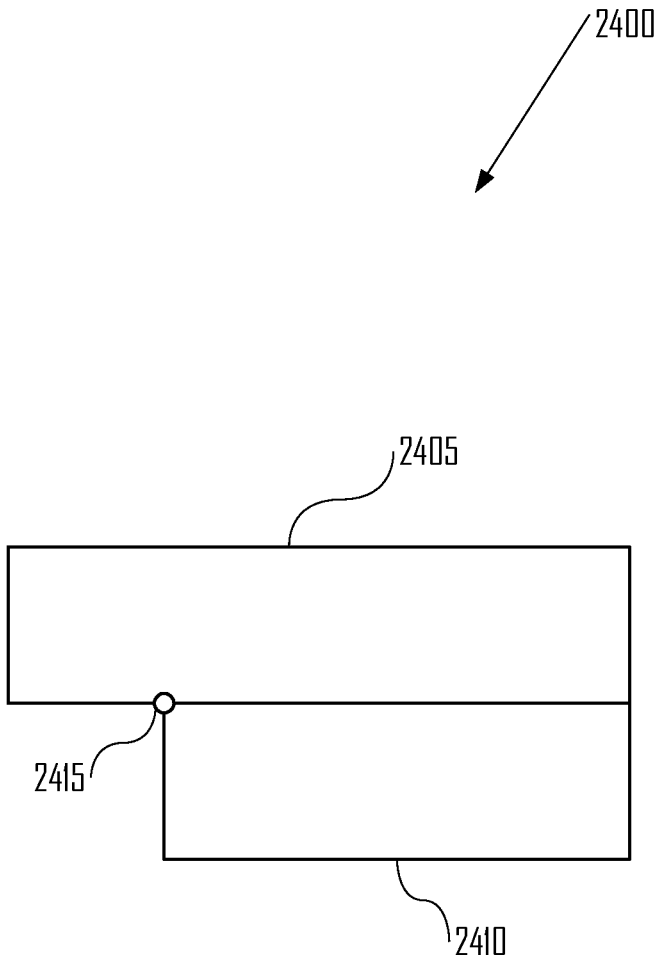
FIG. 25 illustrates a top perspective view of the hinged Sleeve-Post Spacer embodiment illustrated in FIG. 24.
Figure 26:
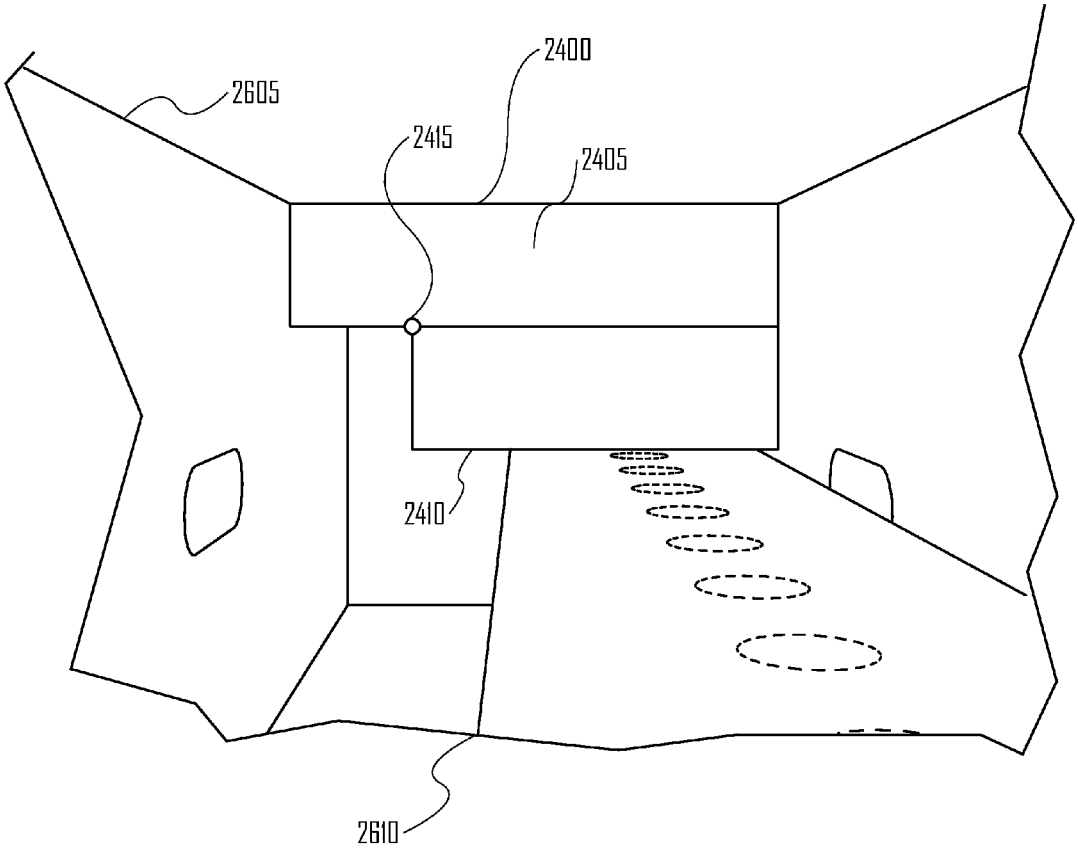
FIG. 26 illustrates a top perspective view of the hinged Sleeve-Post Spacer embodiment illustrated in FIG. 24, further illustrating a Sleeve and a rectangular Post.

FIGS. 25 and 26 may be viewed together, in sequence. FIG. 25 illustrates a top perspective view of the hinged Sleeve-Post Spacer 2400 embodiment illustrated in FIG. 24. FIG. 26 illustrates a top perspective view of the hinged Sleeve-Post Spacer 2400 embodiment illustrated in FIG. 24, further illustrating a Sleeve 2605 and a rectangular Post 2610. The Sleeve 2605 may be, for example 4" on a side (each Panel of Sleeve 2605), while the Post 2610 may be a 2" square metal tube. The Block 2405 may be approximately 4" in length, while Block 2410 is 3" in length, both Blocks are 1" wide, and Hinge 2415 is set back 1" from the end of Block 2405. Spacer 2400 therefore occupies 2" of space between Sleeve 2605 and Post 2610. A second Spacer may be inserted to abut the first.

Figure 27:
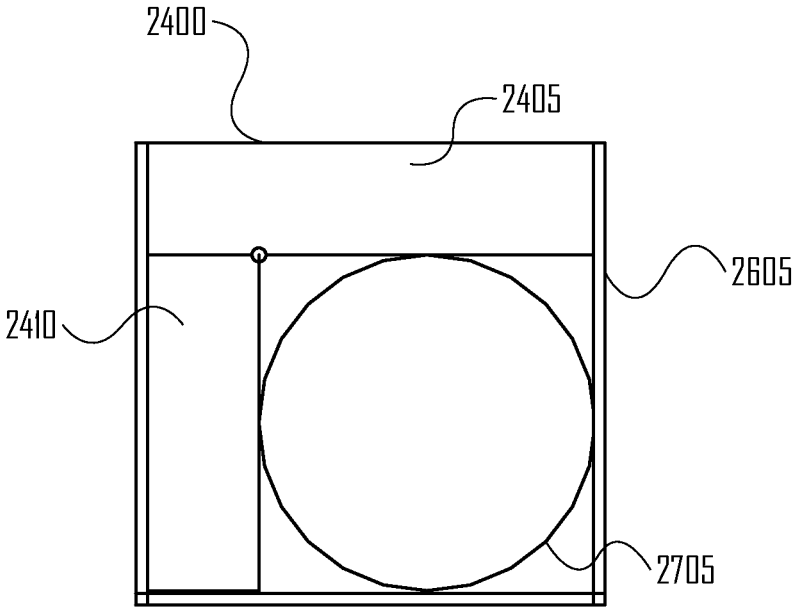
FIG. 27 illustrates a top plan view of the hinged Sleeve-Post Spacer embodiment illustrated in FIG. 24, further illustrating a sleeve, a circular post, and the hinged portion of the spacer deployed.

FIG. 27 illustrates a top plan view of the hinged Sleeve-Post Spacer 2400 embodiment illustrated in FIG. 24, further illustrating the Sleeve 2605, a circular Post 2705, and the hinged portion of the Spacer 2400 deployed. In this illustration, Sleeve 2605 is 4" on a face, Block 2410 is deployed, and spacer occupies 1" of space on each side a 3" circular horizontal cross-section Post 2705.

Figure 28:
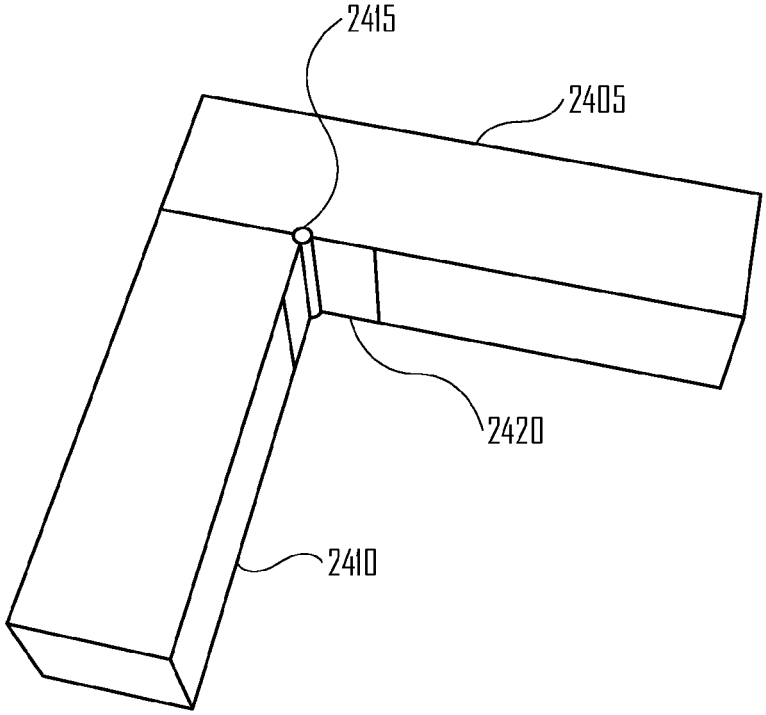
FIG. 28 illustrates a three-quarter perspective view of the hinged sleeve-post spacer embodiment of FIG. 24, but with the hinged portion deployed.

FIG. 28 illustrates a three-quarter perspective view of the hinged Sleeve-Post Spacer 2400 embodiment of FIG. 24, with Block 2410 deployed. This Figure illustrates Fabric 2420, which, as described above, may be part of Hinge 2415.

The above detailed description of embodiments of the Sleeves, Connectors, and Spacers is not intended to be exhaustive or to limit the embodiments to the precise form disclosed above. While specific embodiments of, and examples for, the Sleeves, Connectors, and Spacers are described above for illustrative purposes, various equivalent modifications are possible within the scope of the system, as those skilled in the art will recognize.

The invention claimed is:

1. A structural sign post and visibility sleeve system comprising:

a structural sign post;

a visibility sleeve secured to said structural sign post, the visibility sleeve comprising:

at least a first flat panel and a second flat panel, which first and second flat panels, together, are formed from one continuous material, wherein each panel has a long axis and a short axis; wherein a first panel junction attaches the first and second panels at a first edge along the long axis of the first and second panels, wherein said panel junctions form an angle between the panels, which angle is ninety degrees and which, when the panels are viewed from above, forms an interior area on an interior surface of the panels which is less than an exterior area on an external surface of the panels;

at least a part of one of the panels is divided into a set of vertically arranged rectangular sections, wherein each of the rectangular sections spans the short axis of the at least one panel, and wherein a set of grooves follow a boundary of a rectangular section in the set of rectangular sections and wherein the grooves weaken the attachment of the rectangular section to the visibility sleeve and allow the rectangular section to be removed from the visibility sleeve to accommodate a sign on the structural sign post;

at least a first portion of the external surface of at least one of the panels comprises a color;

at least a second portion of the external surface of at least one of the panels comprises a retroreflective material; and the first and second panels, when connected to the structural sign post with a rectangular cross-section, form substantially flush surfaces with such structural sign post.

2. The visibility sleeve according to claim 1, further comprising at least one opening in at least one of the panels through a fastener that is passed to secure the visibility sleeve the structural sign post.

3. The visibility sleeve according to claim 1, wherein a horizontal cross-section of the first and second panels forms an L shape.

4. The visibility sleeve according to claim 1, further comprising a third flat panel formed from the continuous material of the first and second panels and a second panel junction attaching the third panel to one of the first or second flat panels at a second edge along the long axis of the third panel and the one of the first or second flat panels.

5. The visibility sleeve according to claim 4, wherein a horizontal cross-section of the first, second, and third panels forms a U shape.

6. The visibility sleeve according to claim 4 wherein one of the set of vertically arranged sections is removed from the visibility sleeve to accommodate the sign on the structural sign post, such that the third panel is not as long along its long axis as the long axis of the first and second panels.

7. The visibility sleeve according to claim 4, further comprising a bushing in the interior area, which bushing comprises a receptacle for a head of a fastener and which bushing is sized to fit within corresponding punchout openings in the structural sign post.

8. The visibility sleeve according to claim 4, further comprising a bushing in the interior area, which bushing comprises female threads to receive male threads of a fastener and which bushing is sized to fit within corresponding punchout openings in the structural sign post.

9. The visibility sleeve according to claim 4, further comprising a first bushing and a second bushing in the interior area of the visibility sleeve, wherein the bushings are opposite one another on a same horizontal plane, and wherein the first bushing comprises a receptacle for a head of a fastener and the second bushing comprises female threads to receive male threads in the fastener, which first and second bushings are sized to fit within corresponding punchout openings in the structural sign post.

10. The visibility sleeve according to claim 1, wherein one of the set of vertically arranged sections is removed from the visibility sleeve to accommodate the sign on the structural sign post, such that the first panel is not as long along its long axis as the long axis of the second panel.

11. The sleeve according to claim 1, wherein at least two of the-rectangular sections in the set of rectangular sections correspond to the first and the second portions of the external surface of the at least one panel.

12. The visibility sleeve according to claim 1, wherein the retroreflective material on the second portion comprises linear perforations following the boundary of the rectangular section, wherein the linear perforations allow the retroreflective material on the second portion to be removed along with the rectangular section.

13. The visibility sleeve according to claim 1, wherein the rectangular sections alternate colors along the long axis of the panels.

14. The visibility sleeve according to claim 1, further comprising an adhesive film adhered to the interior surface of the panels.

15. The visibility sleeve according to claim 14, wherein the adhesive film comprises adhesive film perforations following the boundary of the rectangular section wherein the adhesive film perforations allow the adhesive film to be removed along with the rectangular section.

16. The visibility sleeve according to claim 14, wherein the adhesive film has adhesive on a first side of the adhesive film toward the interior area and a second side of the adhesive film toward the exterior area, and wherein the side of the adhesive film toward the interior area further comprises a removable film, wherein the removable film may be removed to allow the side of the adhesive film toward the interior area to be adhered to the structural sign post.

* * * * *